US009299327B1

(12) United States Patent
Steinberger

(10) Patent No.: US 9,299,327 B1
(45) Date of Patent: Mar. 29, 2016

(54) STRING MUSICAL INSTRUMENT HAND SUPPORT APPARATUS

(71) Applicant: Nancy Ann Steinberger, Lakewood, CO (US)

(72) Inventor: Nancy Ann Steinberger, Lakewood, CO (US)

( * ) Notice: Subject to any disclaimer, the term of this patent is extended or adjusted under 35 U.S.C. 154(b) by 0 days.

(21) Appl. No.: 14/874,473

(22) Filed: Oct. 5, 2015

Related U.S. Application Data

(63) Continuation-in-part of application No. 14/611,243, filed on Feb. 1, 2015.

(51) Int. Cl.
*G10D 3/18* (2006.01)

(52) U.S. Cl.
CPC ..... *G10D 3/18* (2013.01)

(58) Field of Classification Search
CPC ..... G10D 3/18
See application file for complete search history.

(56) References Cited

U.S. PATENT DOCUMENTS 401,814 A * 4/1889 Bohmann ..... G10D 3/18 84/328
491,755 A * 2/1893 Le Valley ..... G10D 3/18 84/328
1,156,925 A 10/1915 Poehland
D210,851 S * 4/1968 Wallace ..... 84/328
3,375,747 A * 4/1968 Posey ..... G01D 3/00 84/267
D302,435 S * 7/1989 Pearse ..... D17/20
D381,356 S * 7/1997 Pelkey ..... 84/328
8,927,839 B2 * 1/2015 Hammack ..... G10D 3/18 84/328
2013/0213207 A1 8/2013 Hammack

FOREIGN PATENT DOCUMENTS

DE 10053401 A1 4/2001

* cited by examiner

*Primary Examiner* — Robert W Horn
(74) *Attorney, Agent, or Firm* — Roger A. Jackson

(57) ABSTRACT

A removably engagable string musical instrument hand support apparatus that includes a beam having a first end portion and a second end portion, a principal surface, a minor surface, and a peripheral surface. Further included are first and second extension members that both extend from the minor surface, wherein the extension members contact a body of the musical instrument and the beam forms a non-contacting scaffold adjacent to or over a string of the musical instrument. Also included is a flexible tie having primary and secondary end portions, the primary portion is threaded therethrough the beam and removably engages the instrument, wherein the secondary portion extends from the primary portion to form a lanyard that removably engages the instrument and continues to be threaded therethrough a cinch and the beam forming a hoop assembly also removably engaged to the instrument and threaded back through the beam and cinch.

17 Claims, 23 Drawing Sheets

STRING MUSICAL INSTRUMENT HAND SUPPORT APPARATUS

RELATED PATENT APPLICATIONS

This is a continuation in part (CIP) patent application of U.S. patent application Ser. No. 14/611,243 filed on Feb. 1, 2015 by Nancy Ann Steinberger of Lakewood, Colo., US.

TECHNICAL FIELD

The present invention relates generally to a hand support for string musical instruments. More particularly, the present invention of the string musical instrument hand support apparatus is particularly suited for musical string instruments thus facilitating a hand or wrist rest to allow the strings of the musical instrument to be more easily played to improve speed, tone, accuracy, and to have less hand/wrist fatigue.

BACKGROUND OF INVENTION

Musical string instruments to be played necessitate that the user initiates a vibration via contacting a string being termed picking, plucking, strumming, or striking the selected string of the instrument, wherein the string contact is usually in a rapid sequential movement, wherein multiple strings are contacted in close proximity to one another repeatedly in quick succession. The musical stringed instruments can include guitar, banjo, mandolin, and the like that are typically "plucked" string instruments not "bowed" such as a violin. The user typically positions their hand and/or a portion of their wrist adjacent to a grouping of strings and utilizes one or more of their fingers to strike the string directly or to maneuver a plectrum to accomplish the string contact.

When the user is playing the stringed instrument, common practice is to position the plucking hand by one of three techniques: (1) hovering the hand above the string, (2) anchoring the pinky finger on the top of the instrument body, and (3) resting a portion of the hand on the bridge, top of the instrument body, or on one or more strings. Although the tone and flexibility of the hovering method is optimal, it is extremely difficult to engage the string accurately. Speed can also be limited, since there is no fixed pivot point for rocking the wrist or the hand. In addition, tension and fatigue can be a problem in the hand, wrist, and arm since nothing is being supported. By anchoring the pinky finger on the top of the instrument body, the player has support and a tactile reference point to the string locations, thereby increasing accuracy. However, stiffness in the anchor finger can impact the agility of the other fingers and the hand, increasing tension and fatigue, plus limiting speed.

Also, the location of the anchor point is determined by the player's hand size, and can negatively impact the tone by changing the vibration of the instrument top or body. Resting the hand on the bridge, the top of the instrument body, or on one or more strings provides a support, a tactile reference point to the string locations, and a fixed pivot point for rocking the wrist or hand, however, the tone is often impacted by dampening the vibration of the bridge, the instrument body, or the strings. In addition, the anchor point is again determined by the player's hand size, which may not be optimal for tone production. Unless the user's fingers are extremely long, a player resting their hand on the bridge will strike the strings in a location too close to the bridge, resulting in a bright, harsh tone. Thus, what is needed is a hand rest that provides a tactile reference point to the string locations to improve accuracy, a support to reduce tension and fatigue, a fixed pivot point for rocking the wrist or hand to improve speed, and an adjustable positioning to optimize tone for various hand sizes.

In looking at the prior art in the stringed instrument hand/wrist support arts, in United States Patent Application Publication Number 2013/0213207 to Hammack disclosed is a permanently attached hand rest for a guitar or other such stringed instrument configured to be positioned over strings of the stringed instrument such that a user of the stringed instrument may rest a hand on at least a portion of the hand rest while using the stringed instrument, see FIGS. 1 to 4. Furthermore, in Hammack the hand rest is configured to not interfere with a user striking one or more strings and the vibration of one or more strings, see in particular FIGS. 5 to 7.

Also, in Hammack the hand rest can be pivoted out of the way when it is desired to not use the hand rest, see FIGS. 7 and 8. However, Hammack requires that the hand rest be permanently installed leaving holes in the stringed instrument body, see FIGS. 4 to 8, although in FIGS. 1 to 3, for an acoustic guitar there is shown a screw clamping mechanism for the sound opening of the acoustic guitar body for a removable engagement of the hand rest, however, the clamping mechanisms protrude above the guitar, interfering with the motion of the hand while strumming. In addition, the clamping mechanism would leave crimping marks due to high unit area loading in the body wall, as the body wall is constructed of a relatively soft material, see FIG. 3 in particular.

Further looking at the prior art in the stringed instrument hand/wrist support arts, in U.S. Design Pat. No. D210,851 to Wallace disclosed is a hand rest for guitars or similar articles. The hand rest in Wallace appears to permanently attach to the string bridge fastener on one side of the bridge, with no accommodation of the hand rest offsetting the bridge on one side which could interfere with the string sound function, and which is not movable for different hand positions.

Next, looking at the prior art in the stringed instrument rest/support arts, in U.S. Pat. No. 1,156,925 to Poehland disclosed is a violin shoulder rest that attaches with elastic loops about portions of the violin body. Poehland is for a shoulder rest only and has no scaffold type suspension support over the strings of the violin as the Poehland shoulder rest is disposed opposite of the string side of the body being positioned in-between the violin body and the player/user support shoulder, see in particular FIG. 4.

Further looking at the prior art in the stringed instrument hand/wrist support arts, in German Patent Publication DE10053401 to Heers disclosed is a bridge suspended over the guitar string instrument strings that is attached to the string instrument body via a laterally adjustable "T-Slot" arrangement that is affixed to the body, see in particular FIGS. 21 and 22. Thus, Heers requires permanent holes to be put into the body while allowing for only lateral adjustment, i.e. parallel to the body surface only along the string length.

Continuing in looking at the prior art in the stringed instrument hand/wrist support arts, in U.S. Design Pat. No. D381,356 to Pelkey disclosed is a guitar hand rest. Pelkey appears to have again a permanent attachment of a "U" shaped hand rest to an electric (solid body) guitar being adjacent to the string bridge.

Further continuing in looking at the prior art in the stringed instrument hand/wrist support arts, in U.S. Pat. No. 401,814 to Bohmann disclosed is a string musical instrument having an arm-rest hollowed in the direction of its length to conform to the player's arm, and standing at an angle to the top of the instrument corresponding to the natural angle of the user's hand and arm. Bohmann also has a permanent pivotal attachment of the arm/hand rest on the string instrument body.

In addition, looking at the prior art in the stringed instrument accessory arts pertaining to a rhythm beating and hand/wrist support in U.S. Pat. No. 3,375,747 to Posey disclosed is a guard plate for a stringed instrument such as a guitar including a body from which an elongated neck projects, the strings of the instrument extending from the free end portion of the neck along the latter to a remote portion of said body. The guard plate in Posey comprising a panel-like body including one side surface which is roughened and being adapted for securement to the guitar body along one side of the strings with one side surface of said guard body facing outwardly of the guitar body. Posey also has a permanent attachment of the rhythm beating pad/arm/hand rest on the string instrument body.

What is needed is a string musical instrument hand support apparatus that attaches to the stringed musical instrument in a way that is removably engagable, that in effect creates no permanent holes, markings, grooves, and the like so as not to damage the stringed musical instrument, as many of which have fine finishes and soft thin structures for acoustics that can be easily damaged. Further, the string musical instrument hand support apparatus needs to be secure and stable as attached to the body of the instrument for proper playing by the user, while at the same time the hand support needs to be easily attachable and removable to the body of the stringed musical instrument, and adjustable to different positions for the best tone and hand size.

SUMMARY OF INVENTION

The hand support apparatus being termed the first alternative embodiment for the string musical instrument having a body that includes a prime surface, the body including retention features, and a string retention bridge disposed upon the prime surface such that a string is suspended away from the prime surface. The hand support apparatus includes the beam having the longitudinal axis, with the beam having the first end portion and the opposing second end portion with the longitudinal axis spanning therebetween the first end portion and the second end portion. The beam further having a principal surface and an opposing minor surface, wherein the principal surface and the minor surface span the beam both being substantially parallel to the longitudinal axis, the beam also having a peripheral surface, with the beam first end portion having an first aperture disposed therethrough on the peripheral surface that is positioned between the principal surface and the minor surface. The beam second end portion further having a plurality of second apertures disposed therethrough on the peripheral surface that are positioned between the principal surface and the minor surface.

Further included in the hand support apparatus are the plurality of first extension members each having the first axis, the first extension members each having the first proximal portion and the opposing first distal portion with the first axis spanning therebetween the first proximal portion and the first distal portion, wherein the plurality of first extension members are spaced apart on a branch that is attached to the beam first end portion on the minor surface. The plurality of first extension members are positioned on the branch to oppositely straddle the beam first end portion wherein each first axis is positioned substantially perpendicular to the beam longitudinal axis;

Also included in the hand support apparatus is the second extension member having the second axis, the second extension member having the second proximal portion and the opposing second distal portion with the second axis spanning therebetween the second proximal portion and the second distal portion. The second proximal portion is affixed to the beam second end portion on the minor surface, the second axis is positioned substantially perpendicular to the beam longitudinal axis, wherein each first axis and second axis are positioned substantially parallel to one another and plurality of first extension members and the second extension member both extend away from the beam in substantially a same direction, such that the plurality of first extension members, the beam, and the second extension member form a "U" shape termed an arch.

In addition, included in the hand support apparatus 400 is the flexible tie having the primary end portion and the opposing secondary end portion, the primary end portion is threaded therethrough the first aperture and affixed to the means for removably engaging the body retention feature. The primary end portion depends away from the peripheral surface, the secondary end portion extends from the primary end portion for the secondary portion to form the lanyard that extends to be threaded therethrough the means for cinching and one of the second apertures forming the hoop and continuing to be threaded therethrough another one of the second apertures and further continuing to be threaded therethrough the means for cinching.

The hoop is slidably engaged to a ring, wherein the ring is affixed to a means for removably engaging a body retention feature, wherein operationally the first and second distal portions are drawn to be adjacent to the prime surface via the flexible tie with the minor surface "U" shape arch forming a non-contacting scaffold over or adjacent to the string and the principal surface forming a hand rest for a player of the string musical instrument. Wherein the hand support apparatus is removably engagable to the string musical instrument, the hand support apparatus is engaged to the string musical instrument via manually pulling on the tie secondary end portion with the means for cinching released and the means for removably engaging the body retention feature are engaged to opposing body retention features with the lanyard engaged to another opposing body retention feature wherein when the tie is manually brought taut wherein then the means for cinching is engaged to grip the tie and secure the hand support apparatus to the musical instrument.

These and other objects of the present invention will become more readily appreciated and understood from a consideration of the following detailed description of the exemplary embodiments of the present invention when taken together with the accompanying drawings, in which;

REFERENCE NUMBERS IN DRAWINGS

Figure 1:
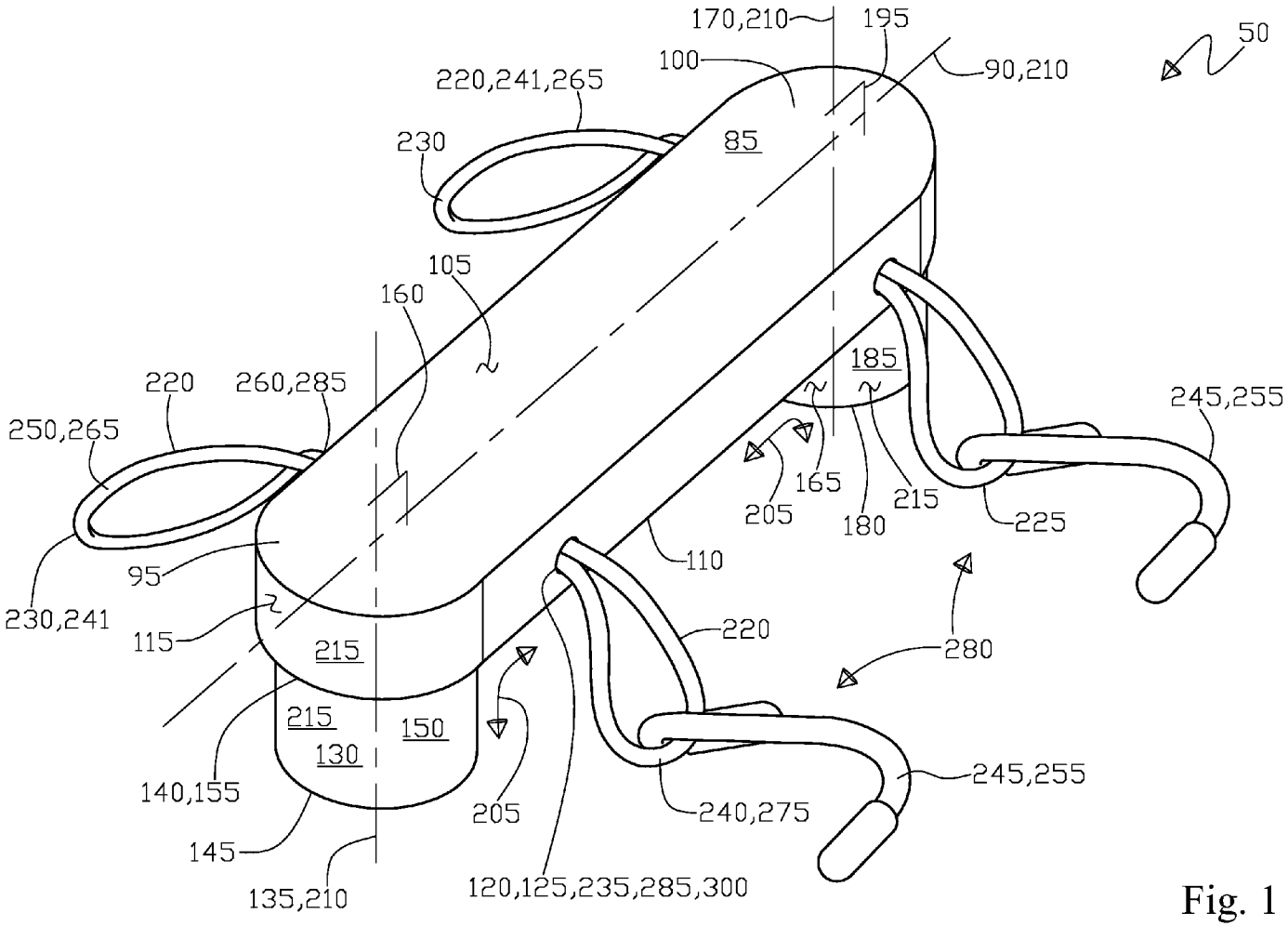
FIG. 1 shows a perspective view of the hand support apparatus disengaged from the musical instrument showing the beam, the first and second end portions of the beam, the principal and minor surfaces of the beam, along with the peripheral surface and cavity of the beam, further shown are the first and second extension members with their respective first and second proximal end portions plus the first and second distal end portions, and first and second perimeter surfaces, with the beam and first and second extension members forming a "U" shaped arch with a flank surface formed from the peripheral surface and the first and second perimeter surfaces, also shown is the elastic finger having primary and secondary end portions that are each affixed to the flank surface and on the opposing ends of the primary and secondary end portions having the means for removable engagement to the body retention features of the musical instrument.

50 Hand Support Apparatus
55 String musical instrument
60 Body of the string musical instrument 55
61 Rear portion of the body 60
65 Prime surface of the string musical instrument 55
70 Retention feature of the body 60 for the string musical instrument 55
75 Opposing retention feature of the body 60 for the string musical instrument 55
80 String retention bridge of the string musical instrument 55
81 String of the string musical instrument 55
82 Player or user of the string musical instrument 55
85 Beam
90 Longitudinal axis of the beam 85
95 First end portion of the beam 85
100 Second end portion of the beam 85
105 Principal surface of the beam 85
110 Minor surface of the beam 85
115 Peripheral surface of the beam 85
120 Cavity of the beam 85 disposed therethrough the beam 85 between the principal 105
and minor 110 surfaces
125 Plurality of the cavities 120 that are each positioned in a spaced apart manner along the longitudinal axis 90
130 First extension member
135 First axis of the first extension member 130
140 First proximal portion of the first extension member 130
145 First distal portion of the first extension member 130
150 First perimeter surface of the first extension member 130
155 Affixment of the first proximal portion 140 to the beam first end portion 95 minor surface 110
160 Perpendicular position of the first axis 135 to the longitudinal axis 90
165 Second extension member
170 Second axis of the second extension member 165
175 Second proximal portion of the second extension member 165
180 Second distal portion of the second extension member 165
185 Second perimeter surface of the second extension member 165
190 Affixment of the second proximal portion 175 to the beam second end portion 100 minor surface 110
195 Perpendicular position of the second axis 170 to the longitudinal axis 90
200 Substantially parallel position of the first 135 and second 170 axes
205 "U" shaped arch of the first extension member 130, the beam 85, and the second extension member 165
210 Axis of the "U" shaped arch 205 that is formed from the longitudinal axis 90, the first axis 135, and the second axis 170
215 Flank surface formed from the peripheral surface 115, the first perimeter surface 150, and the second perimeter surface 185
220 Elastic finger
225 Primary end portion of the elastic finger 220
230 Secondary end portion of the elastic finger 220
235 Affixment of the primary end portion 225 to the flank surface 215
240 Opposing terminal end of the primary end portion 225
241 Opposing terminal end of the secondary end portion 230
245 Means for removable engaging the body retention feature 70
250 Loop of the elastic finger 220 for the means 245, 265 for removable engaging the body retention feature 70
255 Malleable soft surface hook of the elastic finger 220 for the means 245, 265 for removably engaging an opposing body retention feature 75

260 Affixment of the secondary end portion 230 opposite of the primary end portion 225 affixment 235
265 Means for removable engaging the opposing body retention feature 75
270 Scaffold that is non-contacting over the string 81 via the beam 85 and first 130 and second 165 extension members
275 Hand rest for a player 82
280 Spaced apart manner of positioning of a plurality of the elastic fingers 220
285 Affixment of the primary 225 and secondary 230 end portions to the peripheral surface 115
290 Affixment of the primary 225 and secondary 230 end portions to the first perimeter surface 150
295 Affixment of the primary 225 and secondary 230 end portions to the second perimeter surface 185
300 Elastic finger 220 disposed therethrough the cavity 120 in a slidable engagement
305 Initial elastic finger
310 Primary end portion of the initial elastic finger 305
315 Secondary end portion of the initial elastic finger 305
320 Following elastic finger
325 Primary end portion of the following elastic finger 320
330 Secondary end portion of the following elastic finger 320
335 Contact of the initial primary end portion 310 with the peripheral surface 115
340 Contact of the initial secondary end portion 315 with the peripheral surface 115 in an opposing direction
345 Contact of the following primary end portion 325 with an opposing end of the peripheral surface 115
355 Contact of the following secondary end portion 330 with the peripheral surface 115 in an opposing direction
400 Hand support apparatus first alternative embodiment
405 Beam
410 Longitudinal axis of the beam 405
415 First end portion of the beam 405
420 Second end portion of the beam 405
425 Principal surface of the beam 405
430 Minor surface of the beam 405
435 Peripheral surface of the beam 405
450 First extension member
455 First axis of first extension member 450
460 First proximal end portion of first extension member 450
465 First distal end portion of first extension member 450
470 Branch
475 Second extension member
480 Second axis of second extension member 475
485 Second proximal end portion of second extension member 475
490 Second distal end portion of second extension member 475
495 U shaped arch
500 First aperture
505 Second aperture
510 Tie
515 Primary end portion of tie 510
520 Secondary end portion of tie 510
525 Lanyard portion of tie 510
530 Means for cinching
535 Hoop
540 Ring
545 Noose
550 Annular channel
555 Interior section of the annular channel 550
560 Exterior surface of the annular channel 550
565 Protrusions of the annular channel 550
570 Sound hole of the body 60
575 Margin of the sound hole 570
580 Coil of the tie 510
585 Spar
590 Spirals of the spar 585
595 Inner third aperture
600 Hand support apparatus second alternative embodiment
605 Eyelets
610 Friction sleeve
615 Volume knob

DETAILED DESCRIPTION

With initial reference to FIG. 1 shown is a perspective view of the hand support apparatus 50 disengaged from the string musical instrument 55 showing the beam 85, the first 95 and second 100 end portions of the beam 85, the principal 105 and minor 110 surfaces of the beam 85, along with the peripheral surface 115 and cavity 120 of the beam 85. Further shown in FIG. 1 are the first 130 and second 165 extension members with their respective first 140 and second 175 proximal end portions plus the first 145 and second 180 distal end portions, and first 150 and second 185 perimeter surfaces, with the beam 85 and first 130 and second 165 extension members forming a "U" shaped arch 205 with a flank surface 215 formed from the peripheral surface 115 and the first 150 and second 185 perimeter surfaces. Also shown in FIG. 1 is the elastic finger 220 having a primary 225 and secondary 230 end portions that are each affixed 235, 260 to the flank surface 215 and on the opposing ends of the primary 225 and secondary 230 end portions having the means 245 for removable engagement for the body 60 retention feature 70 of the string musical instrument 55.

Figure 2:
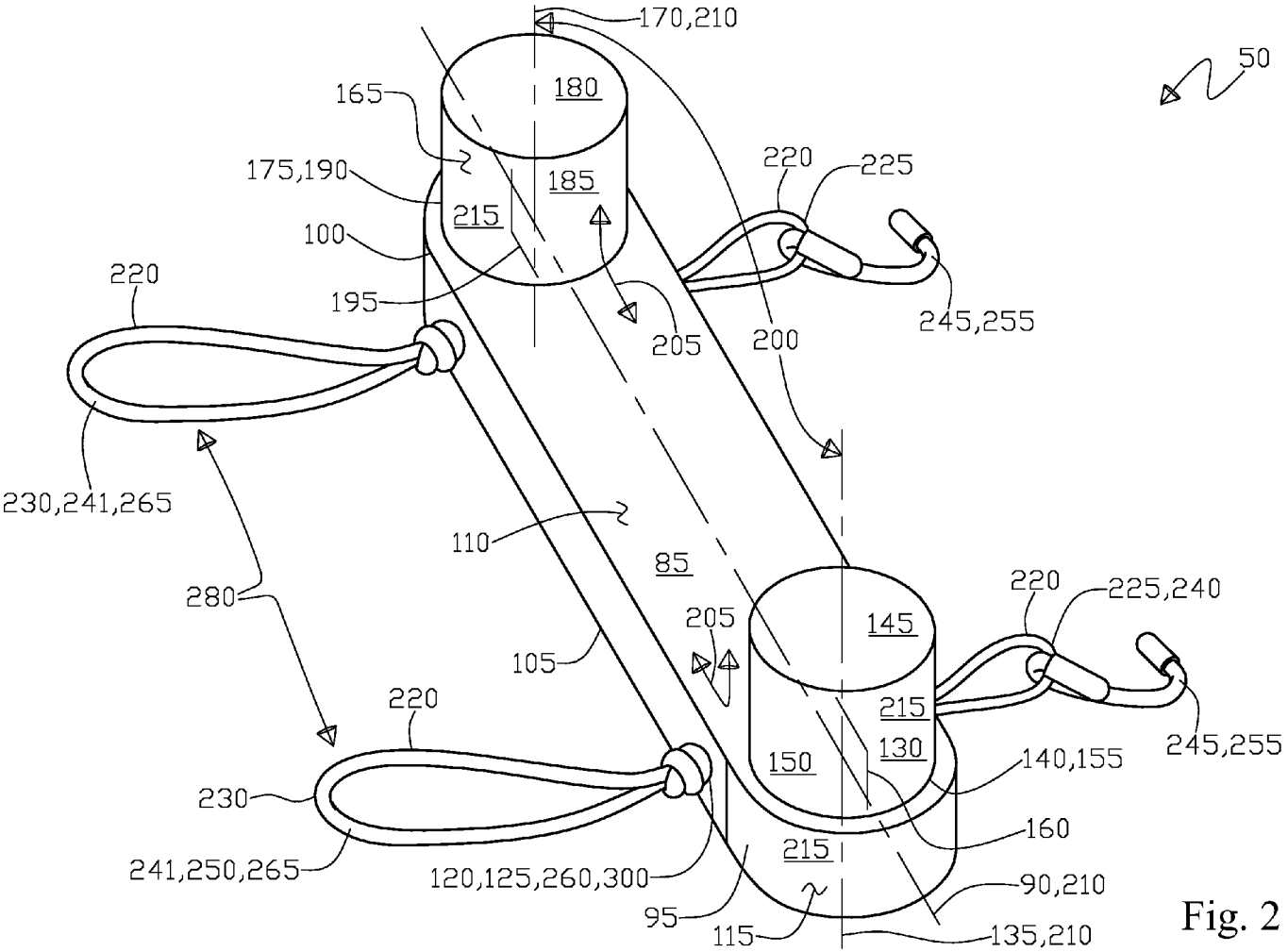
FIG. 2 shows an opposing perspective view of the hand support apparatus in relation to FIG. 1 that has the hand support apparatus disengaged from the musical instrument showing the beam, the first and second end portions of the beam, the principal and minor surfaces of the beam, along with the peripheral surface and cavity of the beam, further shown are the first and second extension members with their respective first and second proximal end portions plus the first and second distal end portions, and first and second perimeter surfaces, with the beam and first and second extension members forming a "U" shaped arch with a flank surface formed from the peripheral surface and the first and second perimeter surfaces, also shown is the elastic finger having primary and secondary end portions that are each affixed to the flank surface and on the opposing ends of the primary and secondary end portions having the means for removable engagement to the body retention features of the musical instrument.

Continuing, FIG. 2 shows an opposing perspective view of the hand support apparatus 50 in relation to FIG. 1 that has the hand support apparatus 50 disengaged from the string musical instrument 55 showing the beam 85, the first 95 and second 100 end portions of the beam 85, the principal 105 and minor 110 surfaces of the beam 85, along with the peripheral surface 115 and cavity 120 of the beam 85. Further shown in FIG. 2 is the first 130 and second 165 extension members with their respective first 140 and second 175 proximal end portions plus the first 145 and second 180 distal end portions, and first 150 and second 185 perimeter surfaces, with the beam 85 and first 130 and second 165 extension members forming a "U" shaped arch 205 with a flank surface 215 formed from the peripheral surface 115 and the first 150 and second 185 perimeter surfaces. Also shown in FIG. 2 is the elastic finger 220 having the primary 225 and secondary 230 end portions that are each affixed 235, 260 to the flank surface 215 and on the opposing ends of the primary 225 and secondary 230 end portions having the means 245 for removable engagement for the body 60 retention feature 70 of the string musical instrument 55.

Figure 3:
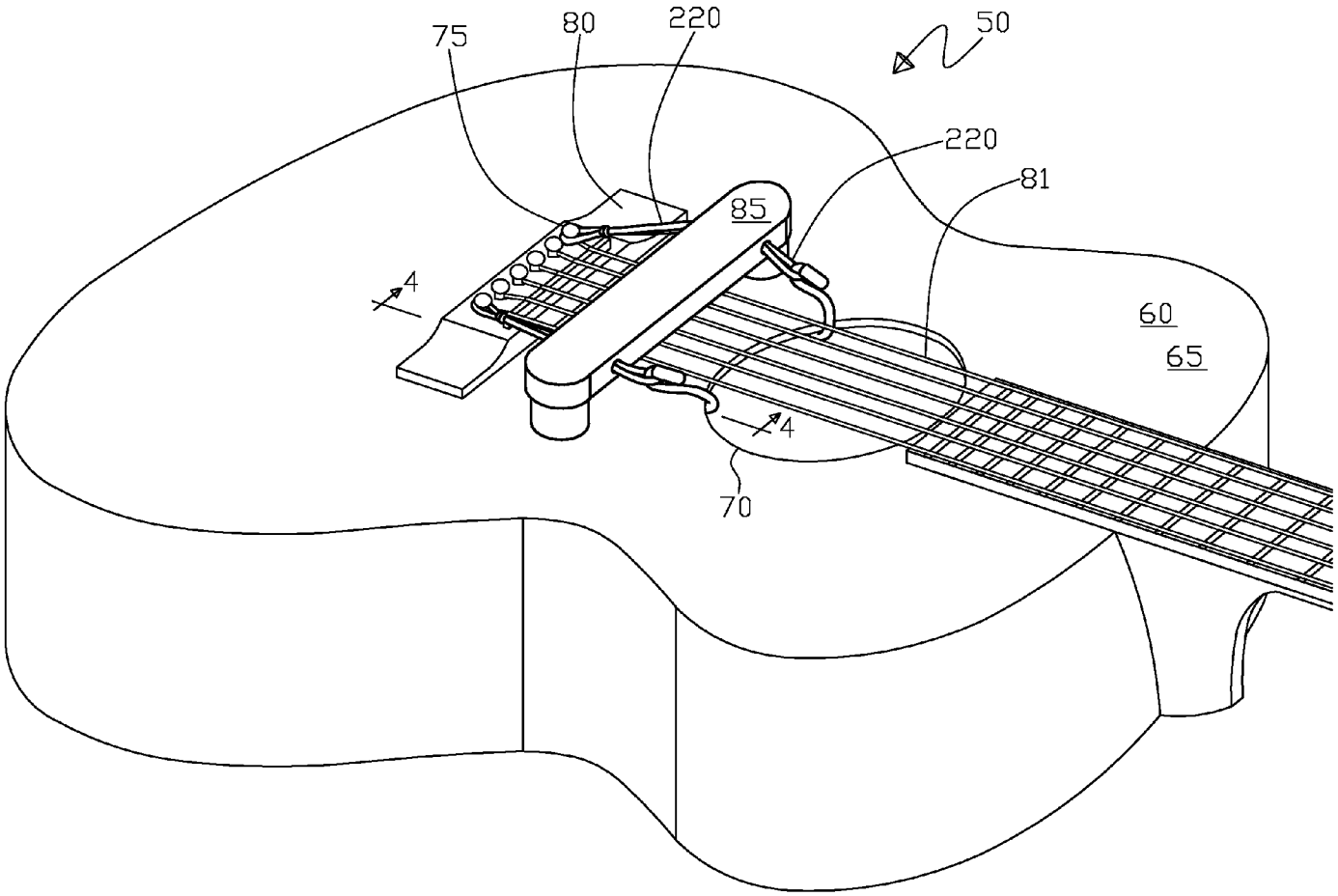
FIG. 3 shows a perspective view of the hand support apparatus installed upon the musical instrument with the means for removable engagement engaging opposing body retention features of the musical instrument in effect holding down the hand support apparatus to the prime surface of the musical instrument body without any permanent markings or openings disposed on the musical instrument, wherein the hand support apparatus is removable from the musical instrument.

Next, FIG. 3 shows a perspective view of the hand support apparatus 50 installed upon the string musical instrument 55 with the means 265 for removable engagement engaging opposing body 60 retention feature 75 of the string musical instrument 55 in effect holding down the hand support apparatus 50 to the prime surface 65 of the string musical instrument 55 body 60 without any permanent markings or openings disposed on the string musical instrument 55 wherein the hand support apparatus 50 is removable from the string musical instrument 55.

Figure 4:
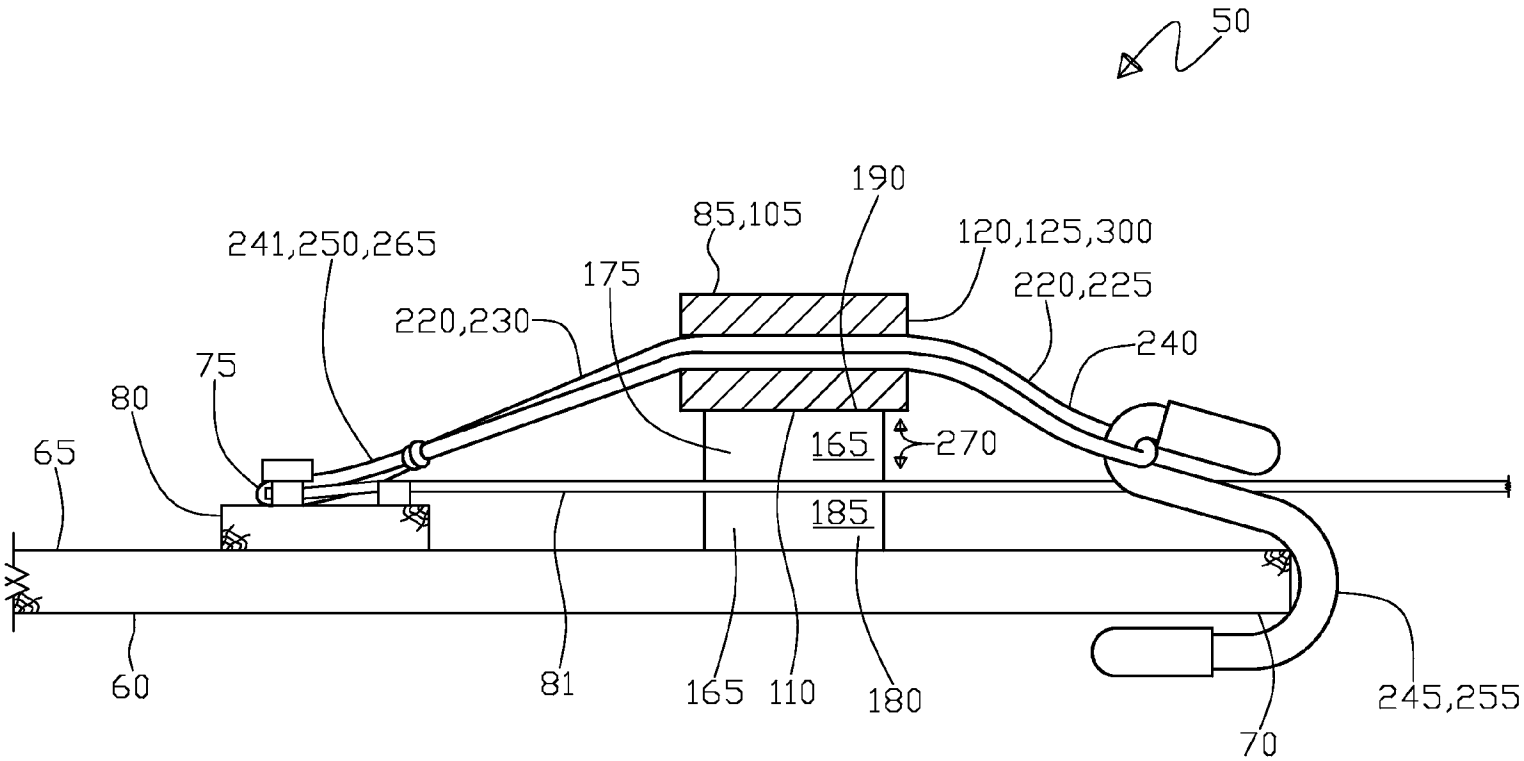
FIG. 4 shows cross section cut 4-4 from FIG. 3 to show a detailed view of the hand support apparatus installed upon the musical instrument with the means for removable engagement engaging opposing body retention features of the musical instrument in effect holding down the hand support apparatus to the prime surface of the musical instrument body without any permanent markings or openings disposed on the musical instrument, wherein the hand support apparatus is removable from the musical instrument, further shown is a cavity of the beam that the elastic finger is slidably engaged with, also shown is the elastic finger having a primary end portion adjacent to the peripheral surface and a secondary end portion adjacent to an opposing peripheral surface, the primary and secondary ends both oppositely depend away from the beam towards the body with the ends having the means to removably engage opposing features of the body, wherein the beam principal surface supports a user's hand over the musical instrument string in the form of a scaffold that is non-contacting over the string for instrument playing.

Further, FIG. 4 shows cross section cut 4-4 from FIG. 3 to show a detailed view of the hand support apparatus 50 installed upon the string musical instrument 55 with the means 265 for removable engagement engaging opposing body 60 retention features 75 of the string musical instrument 55 in effect holding down the hand support apparatus 50 to the prime surface 65 of the string musical instrument 55 body 60 without any permanent markings or openings disposed on the string musical instrument 55, wherein the hand support apparatus 50 is removable from the string musical instrument 55. Further shown in FIG. 4 is the cavity 120 of the beam 85 that the elastic finger 220 is slidably engaged 300 with, also shown is the elastic finger 220 having a primary end portion 225 adjacent to the peripheral surface 115 and a secondary end portion 230 adjacent to an opposing peripheral surface 115, the primary 225 and secondary 230 ends both oppositely depend away from the beam 85 towards the body 60 with the ends 225, 230 having the means 265 to removably engage opposing feature 75 of the body 60. Also shown in FIG. 4 wherein the beam 85 principal surface 105 supports a player user's 82 hand over the string musical instrument 55 string 81 in the form of a scaffold 270 that is non-contacting over the string 81 for instrument 55 playing.

Figure 5:
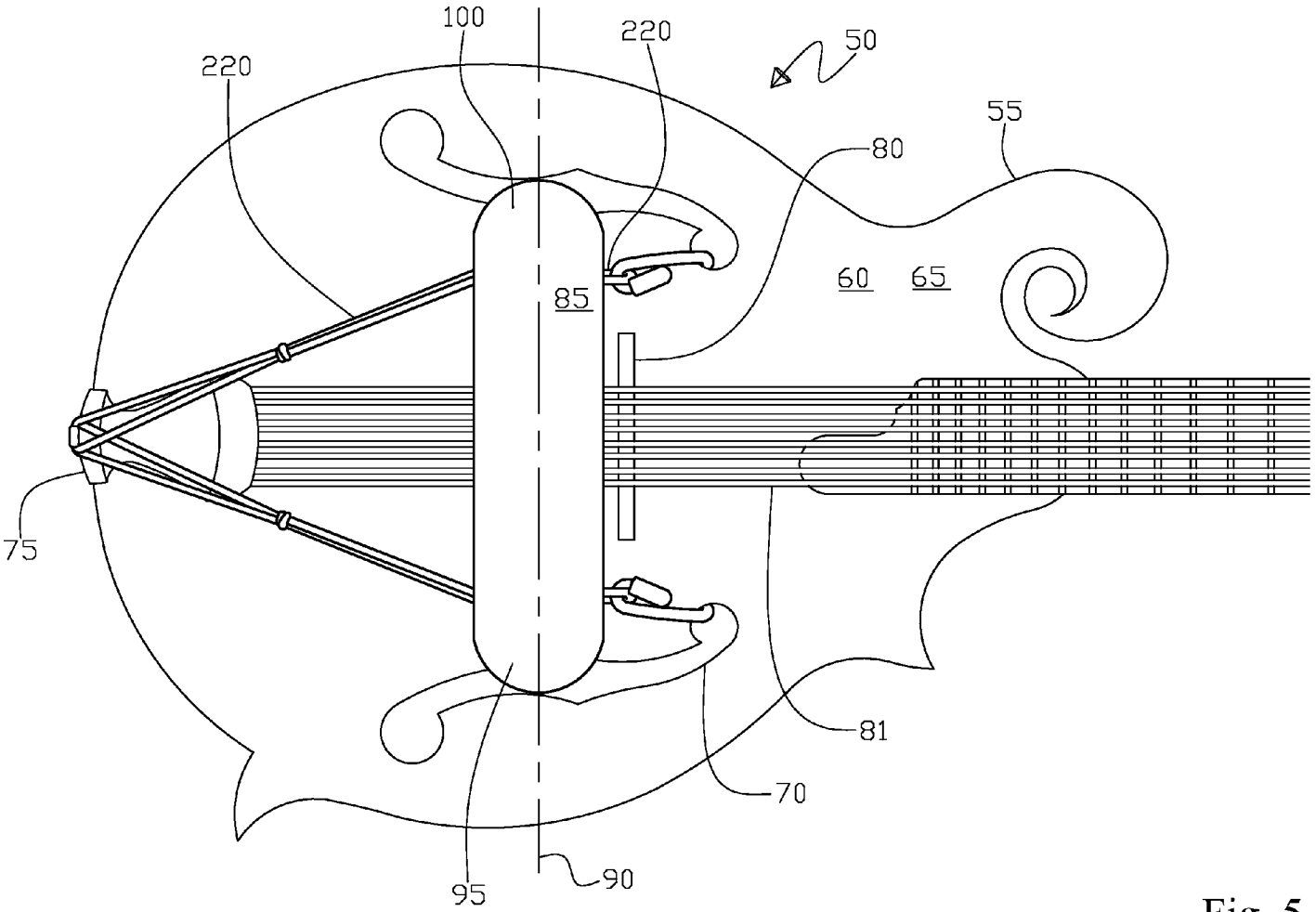
FIG. 5 shows a plan view of the hand support apparatus installed upon the musical instrument being positioned behind the string retention bridge with the means for removable engagement engaging opposing body retention features of the musical instrument in effect holding down the hand support apparatus to the prime surface of the musical instrument body without any permanent markings or openings disposed on the musical instrument, wherein the hand support apparatus is removable from the musical instrument, also shown is the elastic finger having a primary end portion affixed to the peripheral surface and a secondary end portion affixed to an opposing peripheral surface, the primary and secondary ends both oppositely depend away from the beam towards the body with the ends having the means to removably engage opposing features of the body, wherein the beam principal surface supports a user's hand over the musical instrument string in the form of a scaffold that is non-contacting over the string for instrument playing.

Yet further, FIG. 5 shows a plan view of the hand support apparatus 50 installed upon the string musical instrument 55 being positioned behind the string retention bridge 80 with the means 265 for removable engagement engaging opposing body 60 retention feature 75 of the string musical instrument 55 in effect holding down the hand support apparatus 50 to the prime surface 65 of the string musical instrument 55 body 60 without any permanent markings or openings disposed on the string musical instrument 55, wherein the hand support apparatus 50 is removable from the string musical instrument 55. Also shown in FIG. 5 is the elastic finger 220 having a primary end portion 225 affixed to the peripheral surface 115 and a secondary end portion 230 affixed to an opposing peripheral surface 115, the primary 225 and secondary 230 ends both oppositely depend away from the beam 85 towards the body 60 with the ends having the means 265 to removably engage opposing retention features 70, 75 of the body 60, wherein the beam 85 principal surface 105 supports a player user's 82 hand over the string musical instrument 55 string 81 in the form of a scaffold 270 that is non-contacting over the string 81 for string instrument 55 playing by the player user 82.

Figure 6:
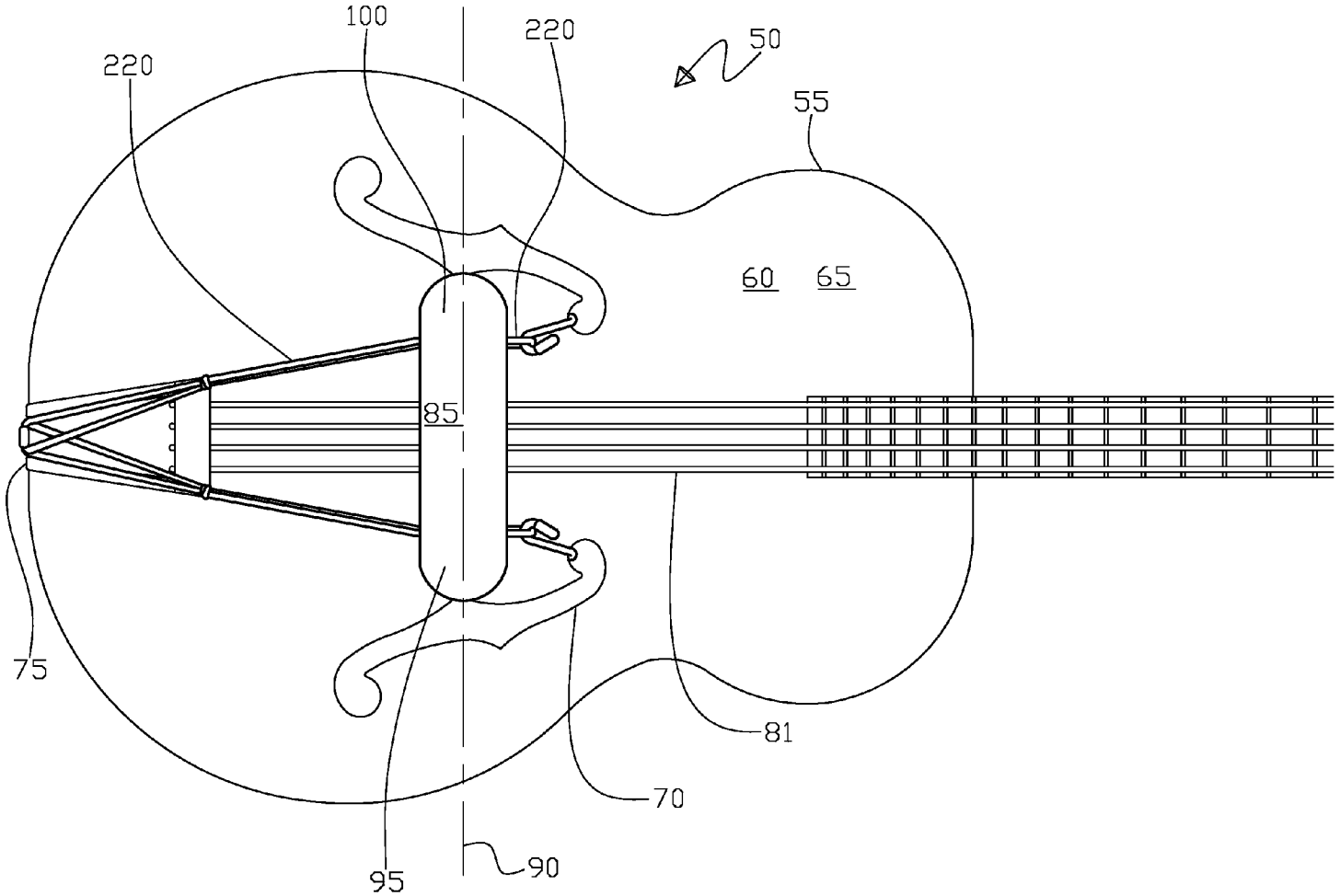
FIG. 6 shows a plan view of the hand support apparatus installed upon the musical instrument straddling above the string retention bridge with the means for removable engagement engaging opposing body retention features of the musical instrument in effect holding down the hand support apparatus to the prime surface of the musical instrument body without any permanent markings or openings disposed on the musical instrument, wherein the hand support apparatus is removable from the musical instrument, also shown is the elastic finger having a primary end portion affixed to the peripheral surface and a secondary end portion affixed to an opposing peripheral surface, the primary and secondary ends both oppositely depend away from the beam towards the body with the ends having the means to removably engage opposing features of the body, wherein the beam principal surface supports a user's hand over the musical instrument string in the form of a scaffold that is non-contacting over the string for instrument playing.

Moving onward, FIG. 6 shows a plan view of the hand support apparatus 50 installed upon the string musical instrument 55 straddling above the string retention bridge 80 with the means 245, 265 for removable engagement engaging opposing body 60 retention features 70, 75 of the string musical instrument 55 in effect holding down the hand support apparatus 50 to the prime surface 65 of the string musical instrument 55 body 60 without any permanent markings or openings disposed on the string musical instrument 55, wherein the hand support apparatus 50 is removable from the string musical instrument 55. Also shown in FIG. 6 is the elastic finger 220 having a primary end portion 225 affixed to the peripheral surface 115 and a secondary end portion 230 affixed to an opposing peripheral surface 115, the primary 225 and secondary 230 ends both oppositely depend away from the beam 85 towards the body 60 with the ends having the means 265 to removably engage opposing features 75 of the body 60, wherein the beam 85 principal surface 105 supports a player user's 82 hand over the string musical instrument 55 string 81 in the form of a scaffold 270 that is non-contacting over the string 81 for string instrument 55 playing by the player user 82.

Figure 7:
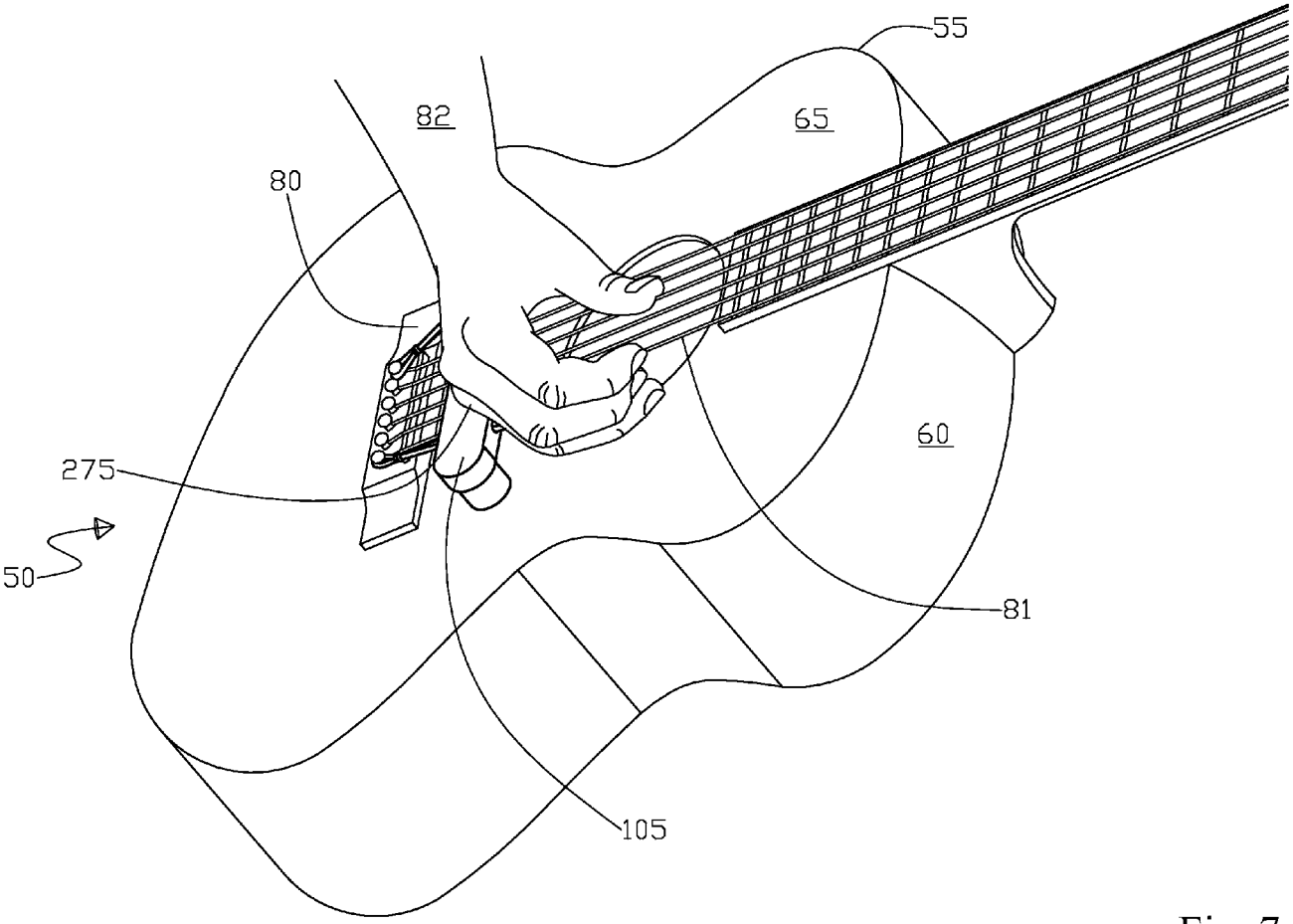
FIG. 7 shows a perspective view of the hand support apparatus installed and in use upon the musical instrument with the means for removable engagement engaging opposing body retention features of the musical instrument in effect holding down the hand support apparatus to the prime surface of the musical instrument body without any permanent markings or openings disposed on the musical instrument, wherein the hand support apparatus is removable from the musical instrument, wherein the player of the musical instrument is resting their hand upon the beam or more particularly the principal surface of the beam to be suspended over the string of the musical instrument.

Continuing, FIG. 7 shows a perspective view of the hand support apparatus 50 installed and in use upon the string musical instrument 55 with the means 245, 265 for removable engagement engaging opposing body 60 retention features 70, 75 of the string musical instrument 55 in effect holding down the hand support apparatus 50 to the prime surface 65 of the string musical instrument 55 body 60 without any permanent markings or openings disposed on the string musical instrument 55, wherein the hand support apparatus 50 is removable from the string musical instrument 55, wherein the player or user 82 of the string musical instrument 55 is resting their hand upon the beam 85 or more particularly the principal surface 105 of the beam 85 to be suspended over the string 81 of the string musical instrument 55.

Figure 8:
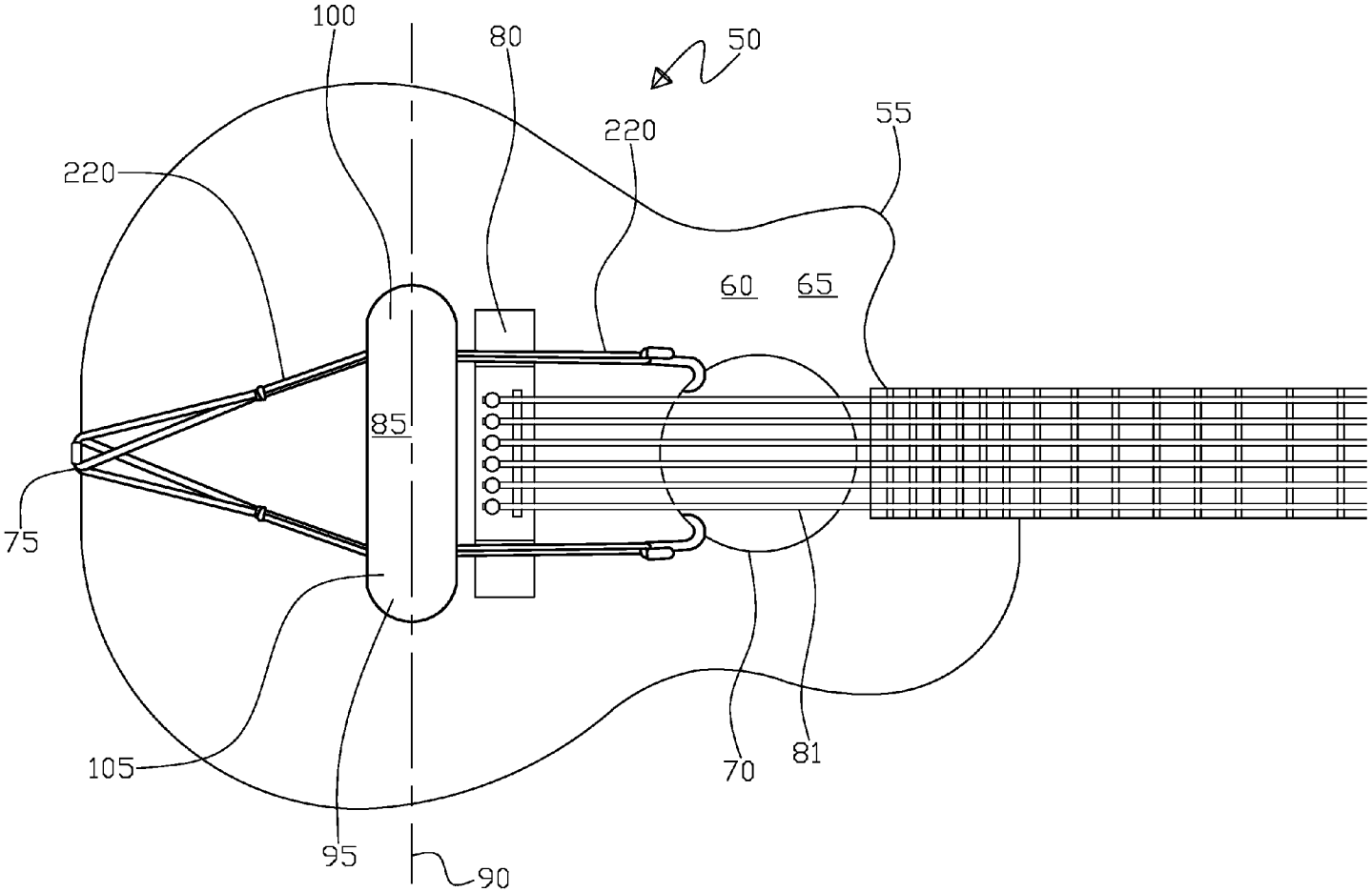
FIG. 8 shows a plan view of the hand support apparatus installed upon the musical instrument being positioned behind the string retention bridge with the means for removable engagement engaging opposing body retention features of the musical instrument in effect holding down the hand support apparatus to the prime surface of the musical instrument body without any permanent markings or openings disposed on the musical instrument, wherein the hand support apparatus is removable from the musical instrument, also shown is the elastic finger having a primary end portion affixed to the peripheral surface and a secondary end portion affixed to an opposing peripheral surface, the primary and secondary ends both oppositely depend away from the beam towards the body with the ends having the means to removably engage opposing features of the body, wherein the beam principal surface supports a user's hand over the musical instrument string in the form of a scaffold that is non-contacting over the string for instrument playing.

Yet further, FIG. 8 shows a plan view of the hand support apparatus 50 installed upon the string musical instrument 55 being positioned behind the string retention bridge 80 with the means 245, 265 for removable engagement engaging opposing body 60 retention features 70, 75 of the string musical instrument 55 in effect holding down the hand support apparatus 50 to the prime surface 65 of the string musical instrument 55 body 60 without any permanent markings or openings disposed on the string musical instrument 55, wherein the hand support apparatus 50 is removable from the string musical instrument 55. Also shown in FIG. 8 is the elastic finger 220 having a primary end portion 225 affixed to the peripheral surface 115 and a secondary end portion 230 affixed to an opposing peripheral surface 115, the primary 225 and secondary 230 ends both oppositely depend away from the beam 85 towards the body 60 with the ends having the means 245, 265 to removably engage opposing features 70, 75 of the body 60, wherein the beam 85 principal surface 105 supports a player user's 82 hand over the string musical instrument 55 string 81 in the form of a scaffold 270 that is non-contacting over the string 81 for string instrument 55 playing by the player user 82.

Figure 9:
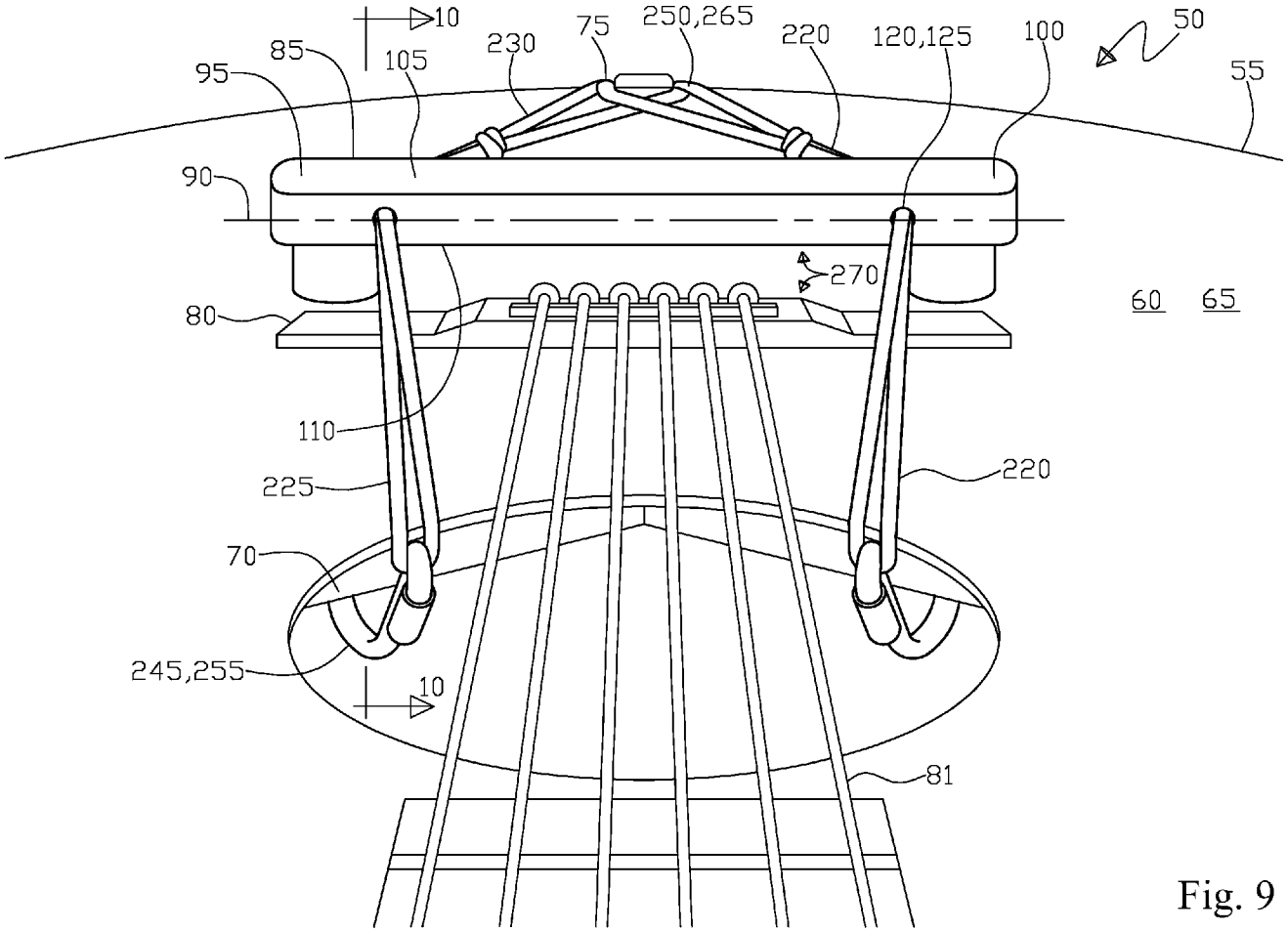
FIG. 9 shows a side elevation view from a neck side of the musical instrument for the hand support apparatus installed upon the musical instrument being positioned behind the string retention bridge with the means for removable engagement engaging opposing body retention features of the musical instrument in effect holding down the hand support apparatus to the prime surface of the musical instrument body without any permanent markings or openings disposed on the musical instrument, wherein the hand support apparatus is removable from the musical instrument, also shown is the elastic finger having a primary end portion slidably engaged to the beam cavity adjacent to the peripheral surface and a secondary end portion slidably engaged to the beam cavity adjacent to the opposing peripheral surface, the primary and secondary ends both oppositely depend away from the beam towards the body with the ends having the means to removably engage opposing features of the body, wherein the beam principal surface supports a user's hand over the musical instrument string in the form of a scaffold that is non-contacting on the beam minor surface over the string for instrument playing.

Further, FIG. 9 shows a side elevation view from a neck side of the string musical instrument 55 for the hand support apparatus 50 installed upon the string musical instrument 55 being positioned behind the string retention bridge 80 with the means 245, 265 for removable engagement engaging opposing body 60 retention features 70, 75 of the string musical instrument 55 in effect holding down the hand support apparatus 50 to the prime surface 65 of the string musical instrument 55 body 60 without any permanent markings or openings disposed on the string musical instrument 55, wherein the hand support apparatus 50 is removable from the string musical instrument 55. Also shown in FIG. 9 is the elastic finger 220 having a primary end portion 225 slidably engaged 300 to the beam 85 cavity 120 adjacent to the peripheral surface 115 and the secondary end portion 230 slidably engaged 300 to the beam 85 cavity 120 adjacent to the opposing peripheral surface 115, the primary 225 and secondary 230 ends both oppositely depend away from the beam 85 towards the body 60 with the ends 225, 230 having the means 245, 265 to removably engage opposing features 70, 75 of the body 60, wherein the beam 85 principal surface 105 supports the player user's 82 hand over the string musical instrument 55 string 81 in the form of a scaffold 270 that is non-contacting on the beam 85 minor surface 110 over the string 81 for string instrument 55 playing by the player 82.

Figure 10:
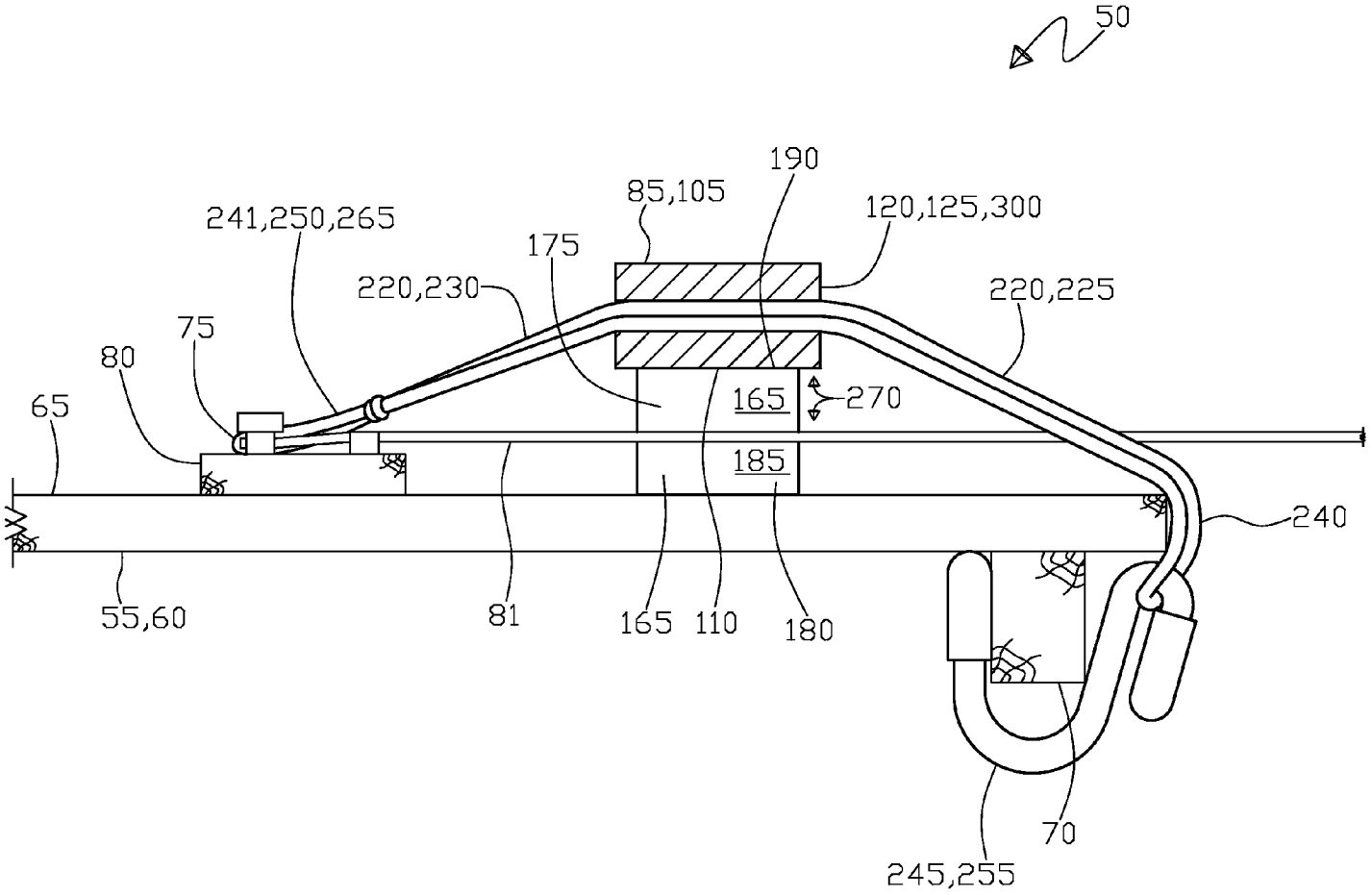
FIG. 10 shows cross section cut 10-10 from FIG. 9 to show a detailed view of the hand support apparatus installed upon the musical instrument however, with FIG. 9 showing the hand support apparatus that can be positioned behind the string retention bridge and FIG. 10 showing the hand support apparatus that can be positioned in front of the string retention bridge with the means for removable engagement engaging opposing body retention features of the musical instrument in effect holding down the hand support apparatus to the prime surface of the musical instrument body without any permanent markings or openings disposed on the musical instrument wherein the hand support apparatus is removable from the musical instrument, further shown is a cavity of the beam that the elastic finger is slidably engaged with, also shown is the elastic finger having a primary end portion adjacent to the peripheral surface and a secondary end portion adjacent to an opposing peripheral surface, the primary and secondary ends both oppositely depend away from the beam towards the body with the ends having the means to removably engage opposing features of the body, wherein the beam principal surface supports a user's hand over the musical instrument string in the form of a scaffold that is non-contacting over the string for instrument playing.

Next, FIG. 10 shows cross section cut 10-10 from FIG. 9 to show a detailed view of the hand support apparatus 50 installed upon the string musical instrument 55 however, with FIG. 9 showing the hand support apparatus 50 that can be positioned behind the string retention bridge 80 and FIG. 10 showing the hand support apparatus 50 that can be positioned in front of the string retention bridge 80. Thus, FIG. 10 shows a detailed view of the hand support apparatus 50 installed upon the string musical instrument 55 with the means 245, 265 for removable engagement engaging opposing body 60 retention features 70, 75 of the string musical instrument 55 in effect holding down the hand support apparatus 50 to the prime surface 65 of the string musical instrument 55 body 60 without any permanent markings or openings disposed on the string musical instrument 55, wherein the hand support apparatus 50 is removable from the string musical instrument 55. Further shown in FIG. 10 is the cavity 120 of the beam 85 that the elastic finger 220 is slidably engaged 300 with, also shown is the elastic finger 220 having a primary end portion 225 adjacent to the peripheral surface 115 and a secondary end portion 230 adjacent to an opposing peripheral surface 115, the primary 225 and secondary 230 ends both oppositely depend away from the beam 85 towards the body 60 with the ends 225, 230 having the means 245, 265 to removably engage opposing features 70, 75 of the body 60. Also shown in FIG. 10 wherein the beam 85 principal surface 105 supports a player user's 82 hand over the string musical instrument 55 string 81 in the form of a scaffold 270 that is non-contacting over the string 81 for instrument 55 playing.

Figure 11:
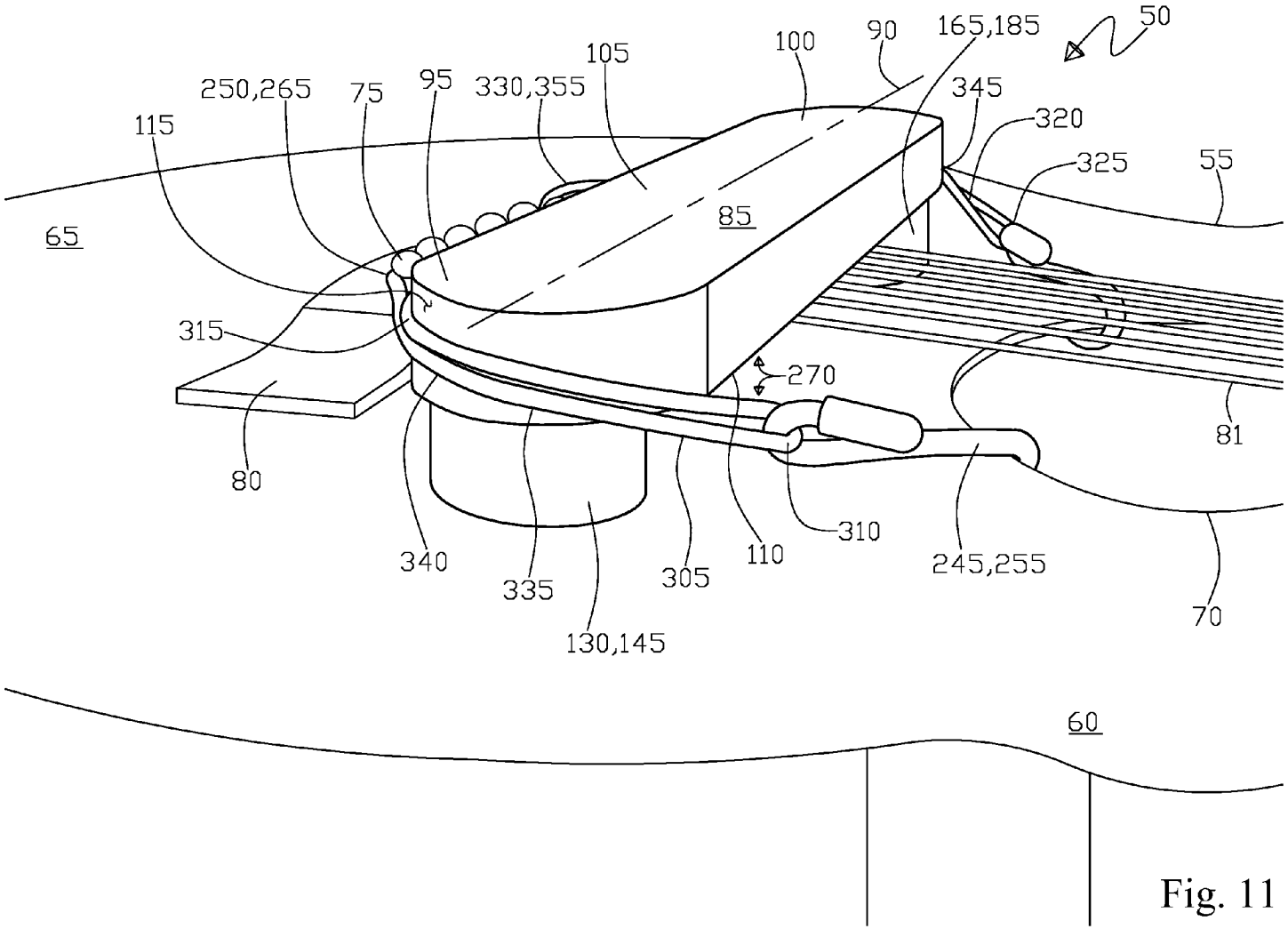
FIG. 11 shows a perspective view of a further alternative embodiment of the hand support apparatus installed upon the musical instrument with the means for removable engagement engaging opposing body retention features of the musical instrument in effect holding down the hand support apparatus to the prime surface of the musical instrument body without any permanent markings or openings disposed on the musical instrument, wherein the hand support apparatus is removable from the musical instrument, further shown are the initial elastic finger with its primary and secondary end portions and the following elastic finger with its primary and secondary end portions along with the non-affixed contacts of the primary and secondary end portions for both the initial and following elastic fingers with the contacts being adjacent to the peripheral surface of the beam, and the means for removable engagement to the opposing body retention features on the primary and secondary end portions, wherein the initial and following elastic fingers in effect compress the beam and pull it toward the prime surface being supported by the first and second extension members to form the scaffold of the beam over the musical instrument string.

Continuing, FIG. 11 shows a perspective view of a further alternative embodiment of the hand support apparatus 50 installed upon the string musical instrument 55 with the means 245, 265 for removable engagement engaging opposing body 60 retention features 70, 75 of the string musical instrument 55 in effect holding down the hand support apparatus 50 to the prime surface 65 of the string musical instrument 55 body 60 without any permanent markings or openings disposed on the string musical instrument 55, wherein the hand support apparatus 50 is removable from the string musical instrument 55. Further shown in FIG. 11 is the initial elastic finger 305 with its primary 310 and secondary end 315 portions and the following elastic finger 320 with its primary 325 and secondary 330 end portions along with the non-affixed contacts 335, 340, 345, 355 of the primary 310, 325 and secondary 315, 330 end portions for both the initial 305 and following 320 elastic fingers with the contacts 335, 340, 345, 355 being adjacent to the peripheral surface 115 of the beam 85, and the means 245, 265 for removable engagement to the opposing body 60 retention features 70, 75 on the primary 310, 325 and secondary 315, 330 end portions. Wherein FIG. 11 shows the initial 305 and following 320 elastic fingers in effect compress the beam 85 and pull it toward the prime surface 65 being supported by the first 130 and second 165 extension members to form the scaffold 270 of the beam 85 over the string musical instrument 55 string 81.

Figure 12:
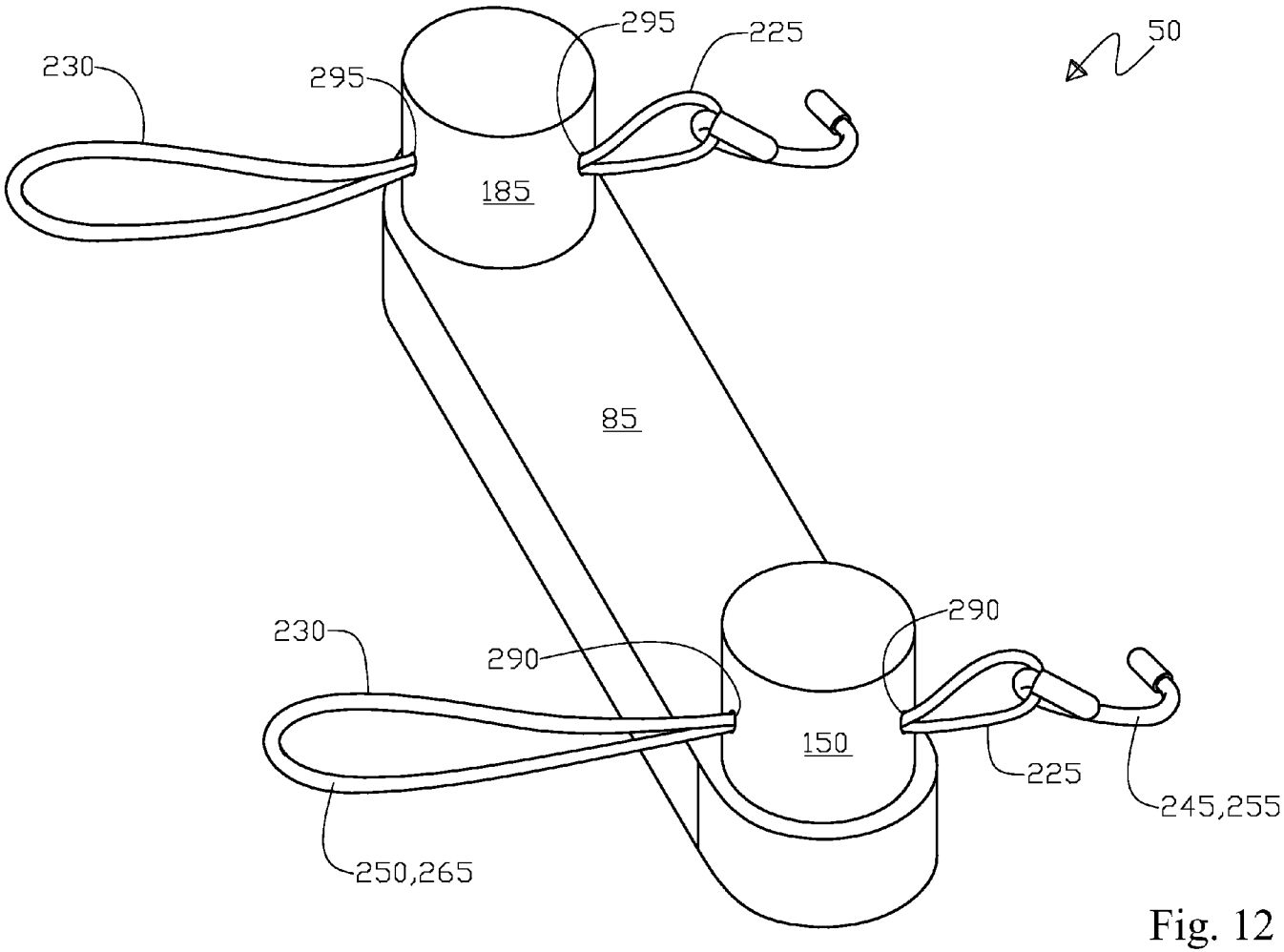
FIG. 12 shows an perspective view of another alternative embodiment of the hand support apparatus that has the hand support apparatus disengaged from the musical instrument showing the beam, the first and second end portions of the beam, the principal and minor surface of the beam, along with the peripheral surface and cavity of the beam, further shown are the first and second extension members with their respective first and second proximal end portions plus the first and second distal end portions, and first and second perimeter surfaces, with the beam and first and second extension members forming a "U" shaped arch with a flank surface formed from the peripheral surface and the first and second perimeter surfaces, also shown is the elastic finger having a primary and secondary end portion that are each affixed to the first and/or second perimeter surfaces of the first and second extension members and on the opposing ends of the primary and secondary end portions having the means for removable engagement for the body retention features of the musical instrument.

Further, FIG. 12 shows an perspective view of another alternative embodiment of the hand support apparatus 50 that has the hand support apparatus 50 disengaged from the string musical instrument 55 showing the beam 85, the first 95 and second 100 end portions of the beam 85, the principal 105 and minor 110 surfaces of the beam 85, along with the peripheral surface 115 and cavity 120 of the beam 85. Further shown in FIG. 12 are the first 130 and second 165 extension members with their respective first 140 and second 175 proximal end portions plus the first 145 and second 180 distal end portions, and first 150 and second 185 perimeter surfaces, with the beam 85 and first 130 and second 165 extension members forming a "U" shaped arch 205 with a flank surface 215 formed from the peripheral surface 115 and the first 150 and second 185 perimeter surfaces. Also shown in FIG. 12 is the elastic finger 220 having a primary 225 and secondary 230 end portions that are each affixed 290, 295 to the first 150 and/or second 185 perimeter surfaces of the first 130 and second 165 extension members and on the opposing ends of the primary 225 and secondary 230 end portions having the means 245, 265 for removable engagement for the body 60 retention features 70, 75 of the string musical instrument 55.

Figure 13:
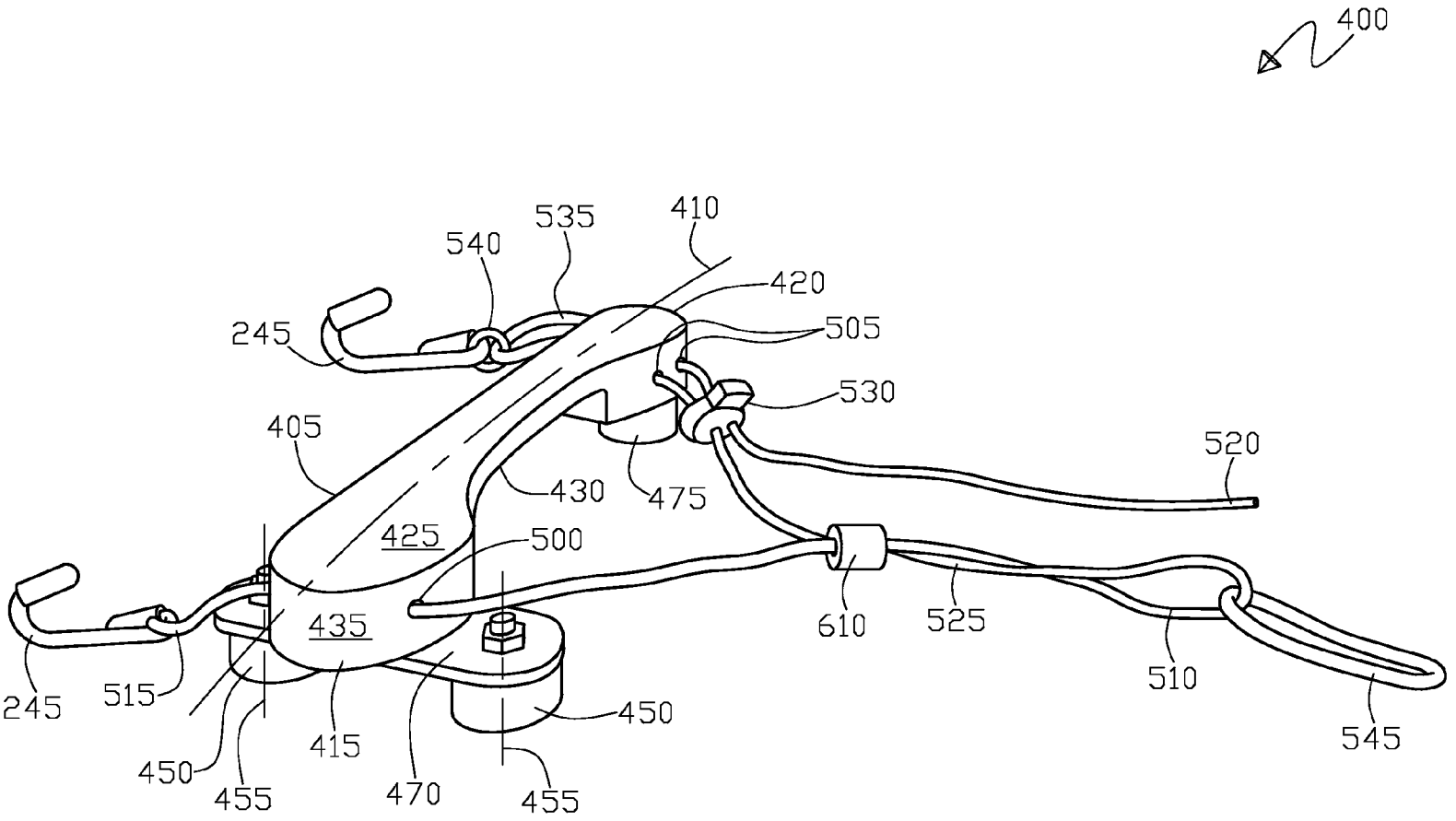
FIG. 13 shows a perspective view of a first alternative embodiment of the hand support apparatus disengaged from the musical instrument showing the beam, the first and second end portions of the beam, the principal and minor surfaces of the beam, along with the peripheral surface, further shown are the first and second extension members with their respective first and second proximal end portions plus the first and second distal end portions, also shown is the routing of the tie, with the primary end portion and the hoop each having the means for removable engagement plus the lanyard for attachment to the body retention features of the musical instrument.

Next, FIG. 13 shows a perspective view of a first alternative embodiment 400 of the hand support apparatus disengaged from the musical instrument 55 showing the beam 405, the first 415 and second 420 end portions of the beam 405, the principal 425 and minor 430 surfaces of the beam 405, along with the peripheral surface 435. Further shown in FIG. 13 are the first 450 and second 475 extension members, also shown is the routing of the tie 510, with the primary end portion 515 and the hoop 535 each having the means for removable engagement 245 plus the lanyard 525 and friction sleeve 610 for attachment to the body retention features 70 of the musical instrument 55.

Figure 14:
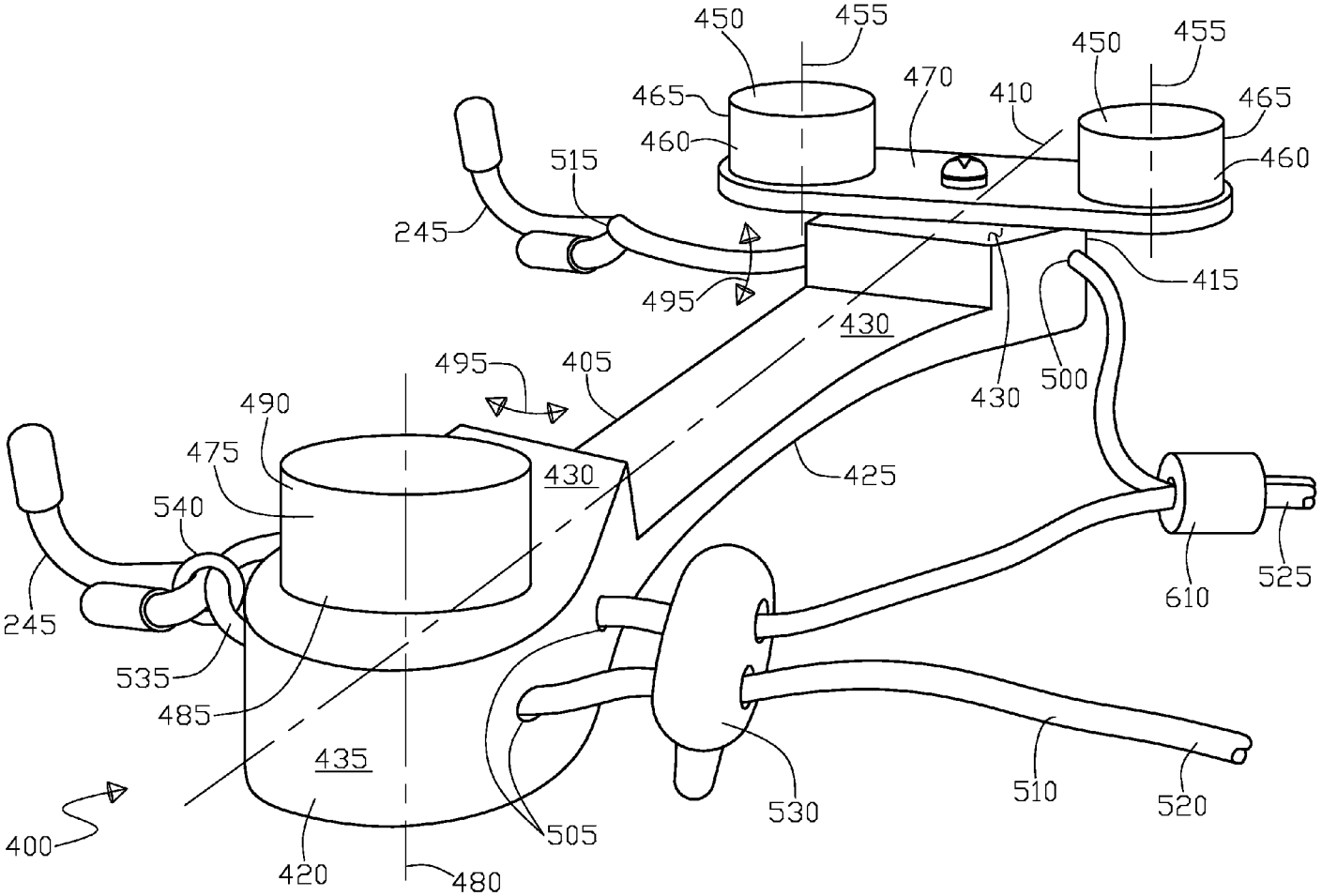
FIG. 14 shows an opposing perspective view of the first alternative embodiment of the hand support apparatus in relation to FIG. 13 that has the hand support apparatus disengaged from the musical instrument showing the beam, the first and second end portions of the beam, the principal and minor surfaces of the beam, along with the peripheral surface, further shown are the first and second extension members with their respective first and second proximal end portions plus the first and second distal end portions, with the beam and first and second extension members forming a "U" shaped arch, also shown is the routing of the tie, with the primary end portion and the hoop having the means for removable engagement plus the lanyard for attachment to the body retention features of the musical instrument.

Continuing, FIG. 14 shows an opposing perspective view of the first alternative embodiment 400 of the hand support apparatus in relation to FIG. 13 that has the hand support apparatus 400 disengaged from the musical instrument 55 showing the beam 405, the first 415 and second 420 end portions of the beam 405, the principal 425 and minor 430 surfaces of the beam 405, along with the peripheral surface 435. Further shown in FIG. 14 are the first 450 and second 475 extension members with their respective first 460 and second 485 proximal end portions plus the first 465 and second 490 distal end portions, with the beam 405 and first 450 and second 475 extension members forming a "U" shaped arch 495, also shown is the routing of the tie 510, with the primary end portion 515 and the hoop 535 having the means for removable engagement 245 plus the lanyard 525 and friction sleeve 610 for attachment to the body retention features 70 of the musical instrument 55.

Figure 15:
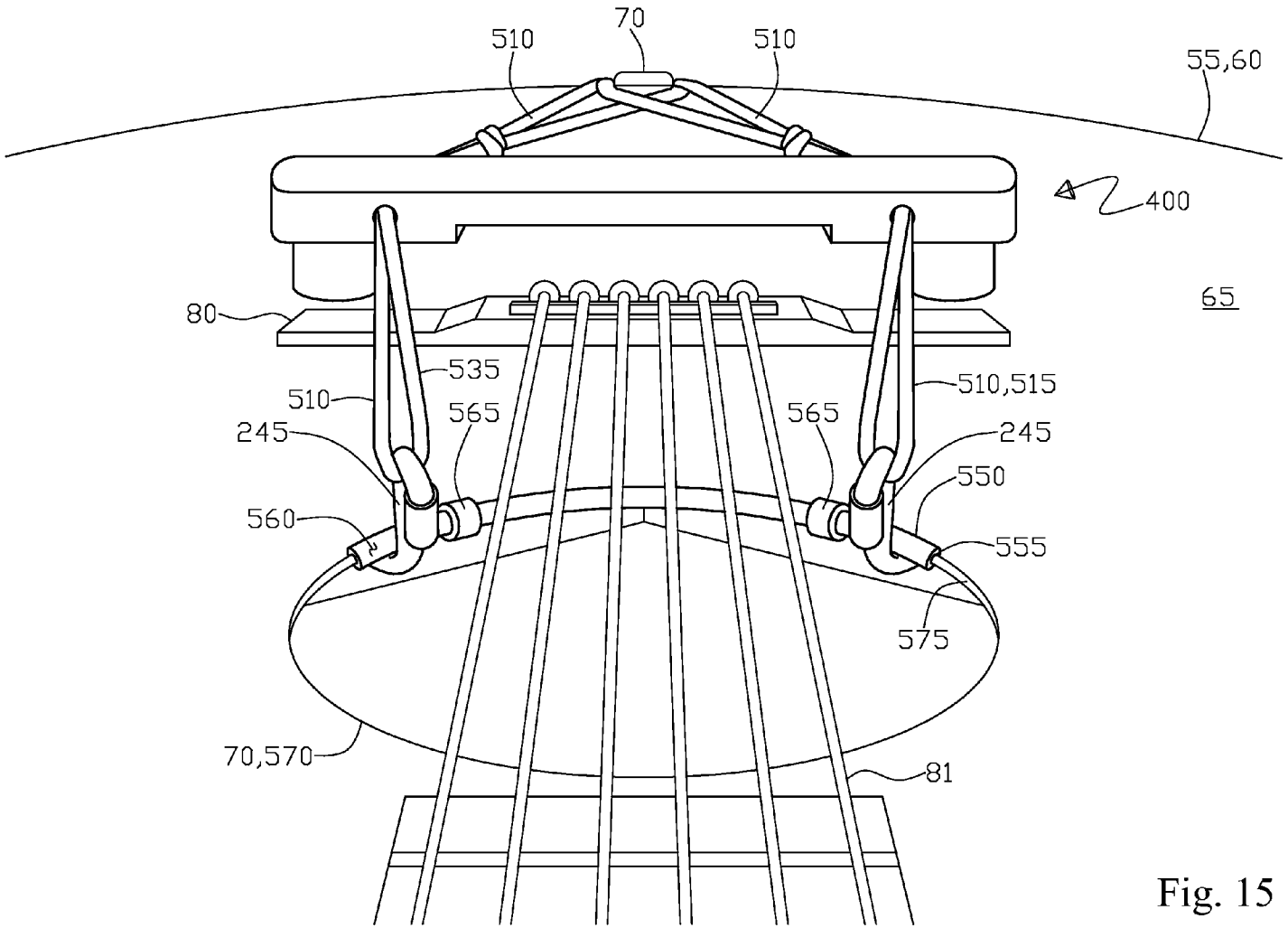
FIG. 15 shows a side elevation view from a neck side of the musical instrument for the hand support apparatus installed upon the musical instrument being positioned behind the string retention bridge with the means for removable engagement engaging opposing body retention features of the musical instrument via the annular channel with protrusions as against the sound hole margin thus in effect holding down the hand support apparatus to the prime surface of the musical instrument body without any permanent markings or new openings disposed on the musical instrument, wherein the hand support apparatus is removable from the musical instrument, also shown is the routing of the tie, with the primary end portion and the hoop each having the means for removable engagement engaged to the annular channel and protrusion interface, plus the tie for attachment to the body retention features of the musical instrument, wherein the beam principal surface supports a user's hand over or adjacent to the musical instrument string in the form of a scaffold that is non-contacting on the beam minor surface over the string for instrument playing.

Moving ahead, FIG. 15 shows a side elevation view from a neck side of the musical instrument 55 for the hand support apparatus 400 installed upon the musical instrument 55 being positioned behind the string retention bridge 80 with the means for removable engagement 245 engaging opposing body retention features 70 of the musical instrument 55 via the annular channel 550 with protrusions 565 as against the sound hole 570 margin 575 thus in effect holding down the hand support apparatus 400 to the prime surface 65 of the musical instrument 55 body 60 without any permanent markings or new openings disposed on the musical instrument 55. Wherein FIG. 15 also shows the hand support apparatus 400 being removable from the musical instrument 55, also shown is the routing of the tie 510, with the primary end portion 515 and the hoop 535 each having the means for removable engagement 245 engaged to the annular channel 550 and protrusion 565 interface, plus the tie 510 for attachment to the body retention features 70 of the musical instrument 55, wherein the beam 405 principal surface 425 supports a user's 82 hand over the musical instrument 55 string 81 in the form of a scaffold that is non-contacting on the beam 405 minor surface 430 or over or adjacent to the string 81 for instrument 55 playing.

Figure 16:
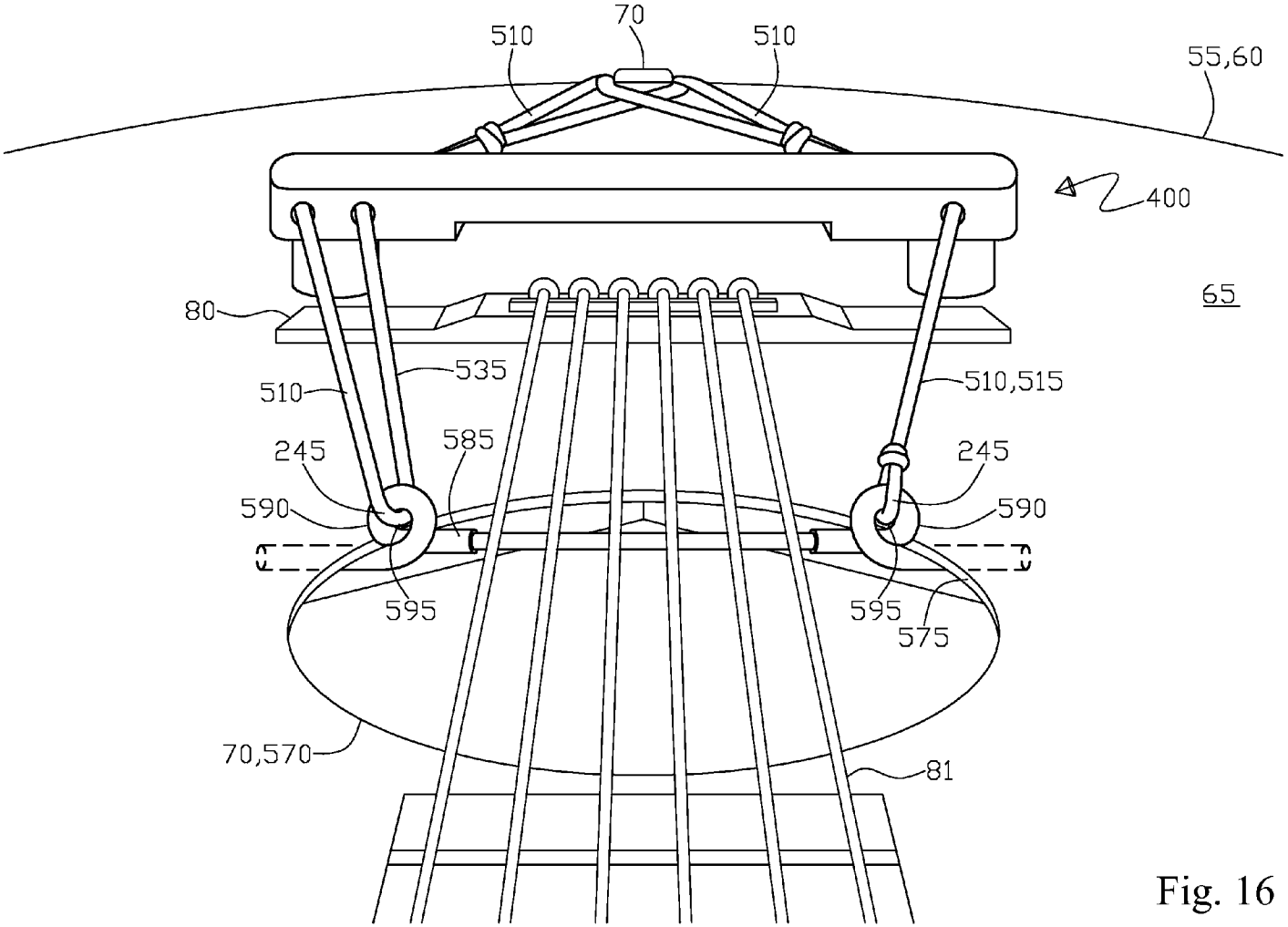
FIG. 16 shows a side elevation view from a neck side of the musical instrument for the hand support apparatus installed upon the musical instrument being positioned behind the string retention bridge with the means for removable engagement engaging opposing body retention features of the musical instrument via the spar with a pair of spirals each having an inner third aperture, wherein the spirals wedge as against the sound hole margin thus in effect holding down the hand support apparatus to the prime surface of the musical instrument body without any permanent markings or new openings disposed on the musical instrument, wherein the hand support apparatus is removable from the musical instrument, also shown is the routing of the tie, with the primary end portion and the hoop each having the means for removable engagement engaged to the inner third apertures, plus the tie for attachment to the body retention features of the musical instrument, wherein the beam principal surface supports a user's hand over or adjacent to the musical instrument string in the form of a scaffold that is non-contacting on the beam minor surface over the string for instrument playing.

Next, FIG. 16 shows a side elevation view from a neck side of the musical instrument 55 for the hand support apparatus 400 installed upon the musical instrument 55 being positioned behind the string retention bridge 80 with the means for removable engagement 245 engaging opposing body retention features 70 of the musical instrument 55 via the spar 585 with a pair of spirals 590 each having an inner third aperture 595, wherein the spirals 590 wedge as against the sound hole 570 margin 575. Thus FIG. 16 shows in effect holding down of the hand support apparatus 400 to the prime surface 65 of the musical instrument 55 body 60 without any permanent markings or new openings disposed on the musical instrument 55, wherein the hand support apparatus 400 is removable from the musical instrument 55, also shown is the routing of the tie 510, with the primary end portion 515 and the hoop 535 each having the means for removable engagement 245 engaged to the inner third apertures 595, plus the tie 510 for attachment to the body retention features 70 of the musical instrument 55, wherein the beam 405 principal surface 425 supports a user's 82 hand over the musical instrument 55 string 81 in the form of a scaffold that is non-contacting on the beam 405 minor surface 430 over or adjacent to the string 81 for instrument 55 playing.

Figure 17:
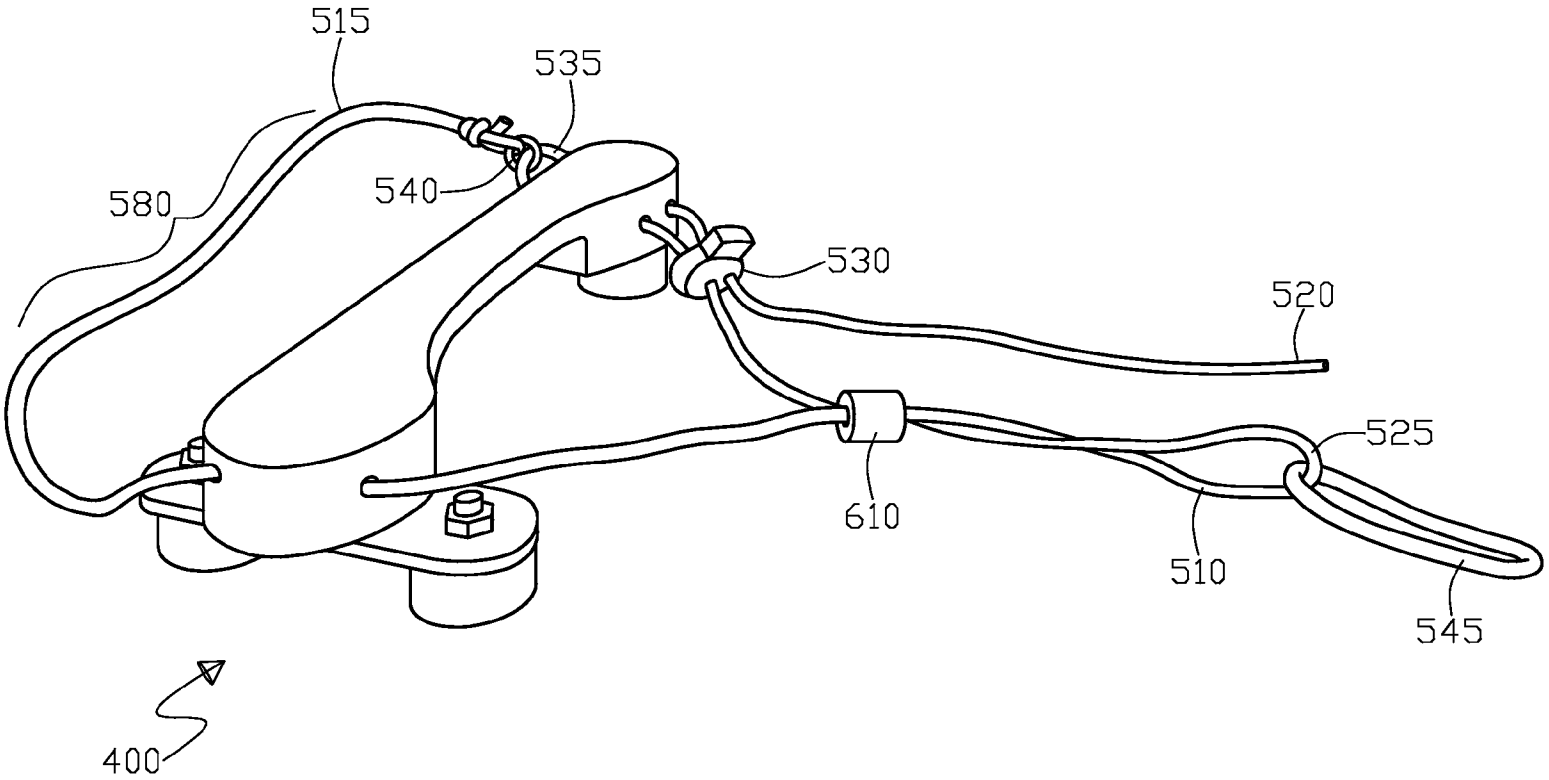
FIG. 17 shows a perspective view of the first alternative embodiment of the hand support apparatus disengaged from the musical instrument showing the beam, the first and second end portions of the beam, the principal and minor surfaces of the beam, along with the peripheral surface, further shown are the first and second extension members with their respective first and second proximal end portions plus the first and second distal end portions, also shown is the routing of the tie, with the primary end portion and the coil, plus the lanyard for attachment to the body retention features of the musical instrument.

Following onward, FIG. 17 shows a perspective view of the first alternative embodiment 400 of the hand support apparatus disengaged from the musical instrument 55 showing the beam 405, the first 415 and second 420 end portions of the beam 405, the principal 425 and minor 430 surfaces of the beam 405, along with the peripheral surface 435, further shown are the first 450 and second 475 extension members with their respective first 460 and second 485 proximal end portions plus the first 465 and second 490 distal end portions, also shown is the routing of the tie 510, with the primary end portion 515 and the coil 580, plus the lanyard 525 and friction sleeve 610 for attachment to the body retention features 70 of the musical instrument 55. Note that FIG. 17 shows the same detail as FIG. 13 relating to the first 450 and second 475 extension members and their associated elements that are detailed in FIG. 13 being the same as those in FIG. 17, with the exception of the tie 510 specifics related to the coil 580 that are different in FIG. 17 from FIG. 13.

Figure 18:
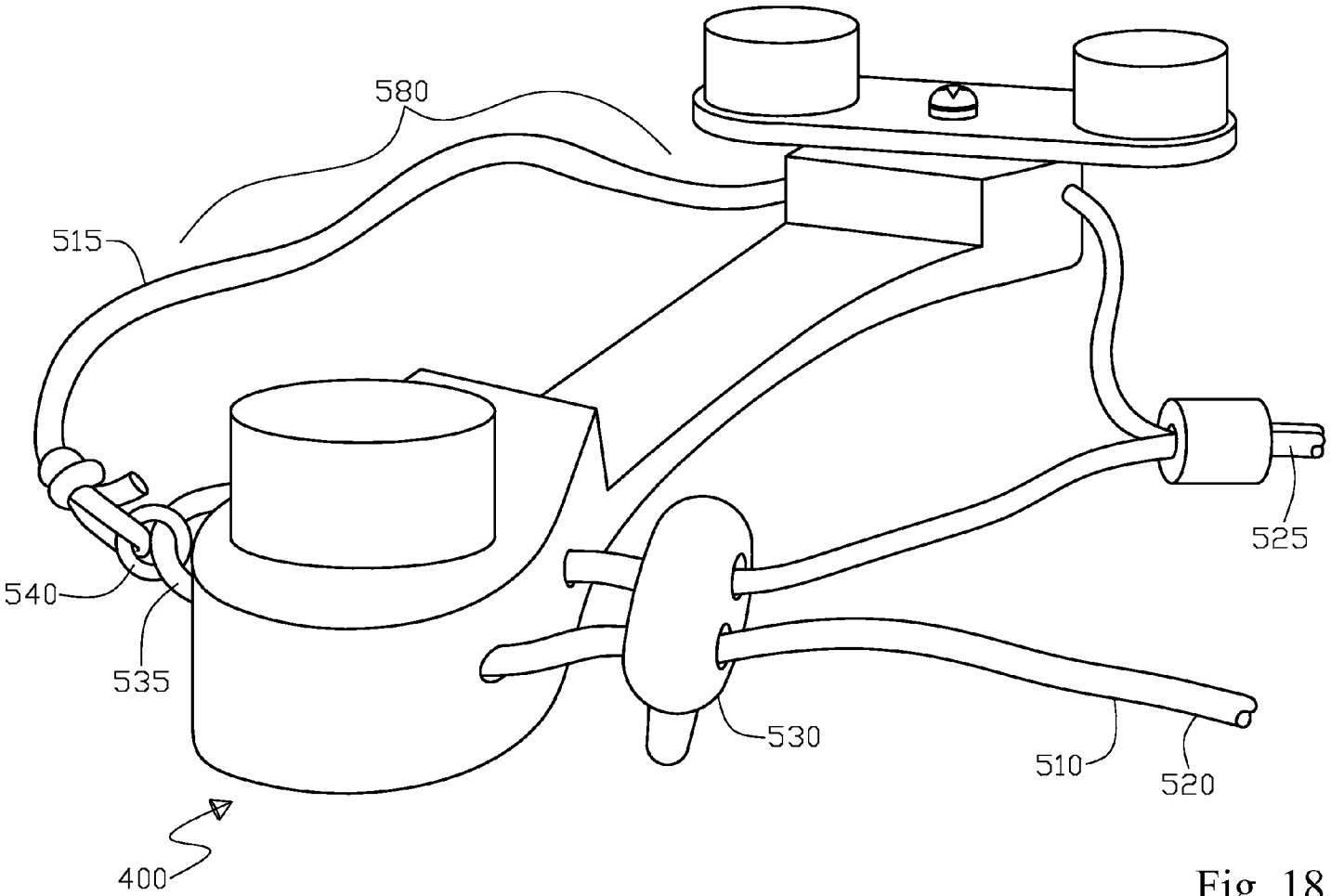
FIG. 18 shows an opposing perspective view of the first alternative embodiment of the hand support apparatus in relation to FIG. 17 that has the hand support apparatus disengaged from the musical instrument showing the beam, the first and second end portions of the beam, the principal and minor surfaces of the beam, along with the peripheral surface, further shown are the first and second extension members with their respective first and second proximal end portions plus the first and second distal end portions, with the beam and first and second extension members forming a "U" shaped arch, also shown is the routing of the tie, with the primary end portion and the coil, plus the lanyard for attachment to the body retention features of the musical instrument.

Next, FIG. 18 shows an opposing perspective view of the first alternative embodiment 400 of the hand support apparatus in relation to FIG. 17 that has the hand support apparatus 400 disengaged from the musical instrument 55 showing the beam 405, the first 415 and second 420 end portions of the beam 405, the principal 425 and minor 430 surfaces of the beam 405, along with the peripheral surface 435. Further shown in FIG. 18 are the first 450 and second 475 extension members with their respective first 460 and second 485 proximal end portions plus the first 465 and second 490 distal end portions, with the beam 405 and first 450 and second 475 extension members forming a "U" shaped arch 495, also shown is the routing of the tie 510, with the primary end portion 515 and the coil 580, plus the lanyard 525 and friction sleeve 610 for attachment to the body retention features 70 of the musical instrument 55. Note that FIG. 18 shows the same detail as FIG. 14 relating to the first 450 and second 475 extension members and their associated elements that are detailed in FIG. 14 being the same as those in FIG. 18, with the exception of the tie 510 specifics related to the coil 580 that are different in FIG. 18 from FIG. 14.

Figure 19:
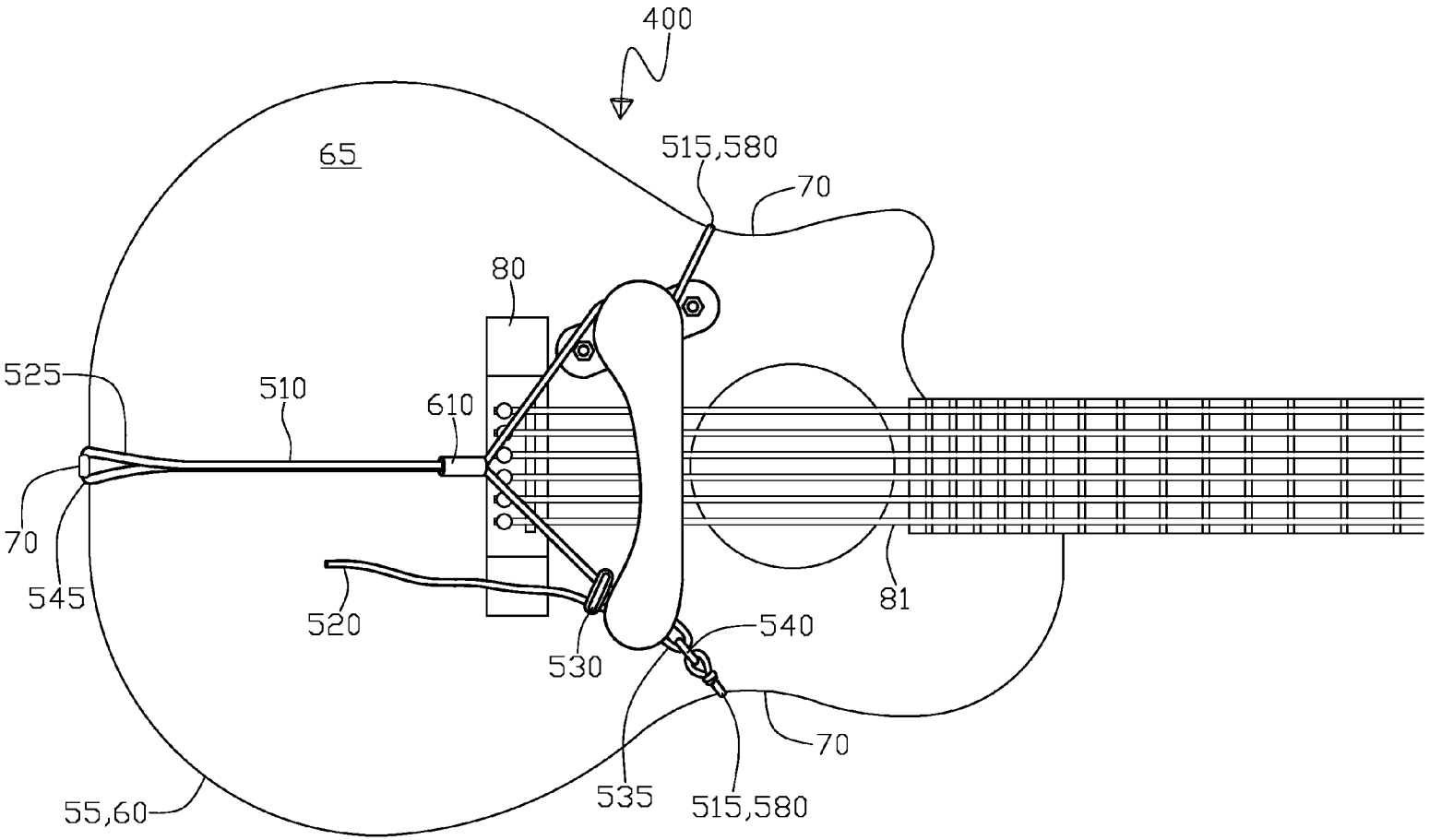
FIG. 19 shows a plan view of the first alternative embodiment of the hand support apparatus installed upon the musical instrument being positioned ahead of the string retention bridge with the tie coil and lanyard removably engaging opposing body retention features of the musical instrument in effect holding down the hand support apparatus to the prime surface of the musical instrument body without any permanent markings or openings disposed on the musical instrument, wherein the hand support apparatus is removable from the musical instrument, wherein the beam principal surface supports a user's hand over or adjacent to the musical instrument string in the form of a scaffold that is non-contacting or adjacent to or over the string for instrument playing.

Continuing, FIG. 19 shows a plan view of the first alternative embodiment 400 of the hand support apparatus installed upon the musical instrument 55 being positioned ahead of the string retention bridge 80 with the tie 510 coil 580 and lanyard 525 removably engaging opposing body retention features 70 of the musical instrument 55 in effect holding down the hand support apparatus 400 to the prime surface 65 of the musical instrument 55 body 60 without any permanent markings or openings disposed on the musical instrument 55, wherein the hand support apparatus 400 is removable from the musical instrument 55, wherein the beam 405 principal surface 425 supports a user's 82 hand over the musical instrument 55 string 81 in the form of a scaffold that is non-contacting over or adjacent to the string 81 for instrument 55 playing.

Figure 20:
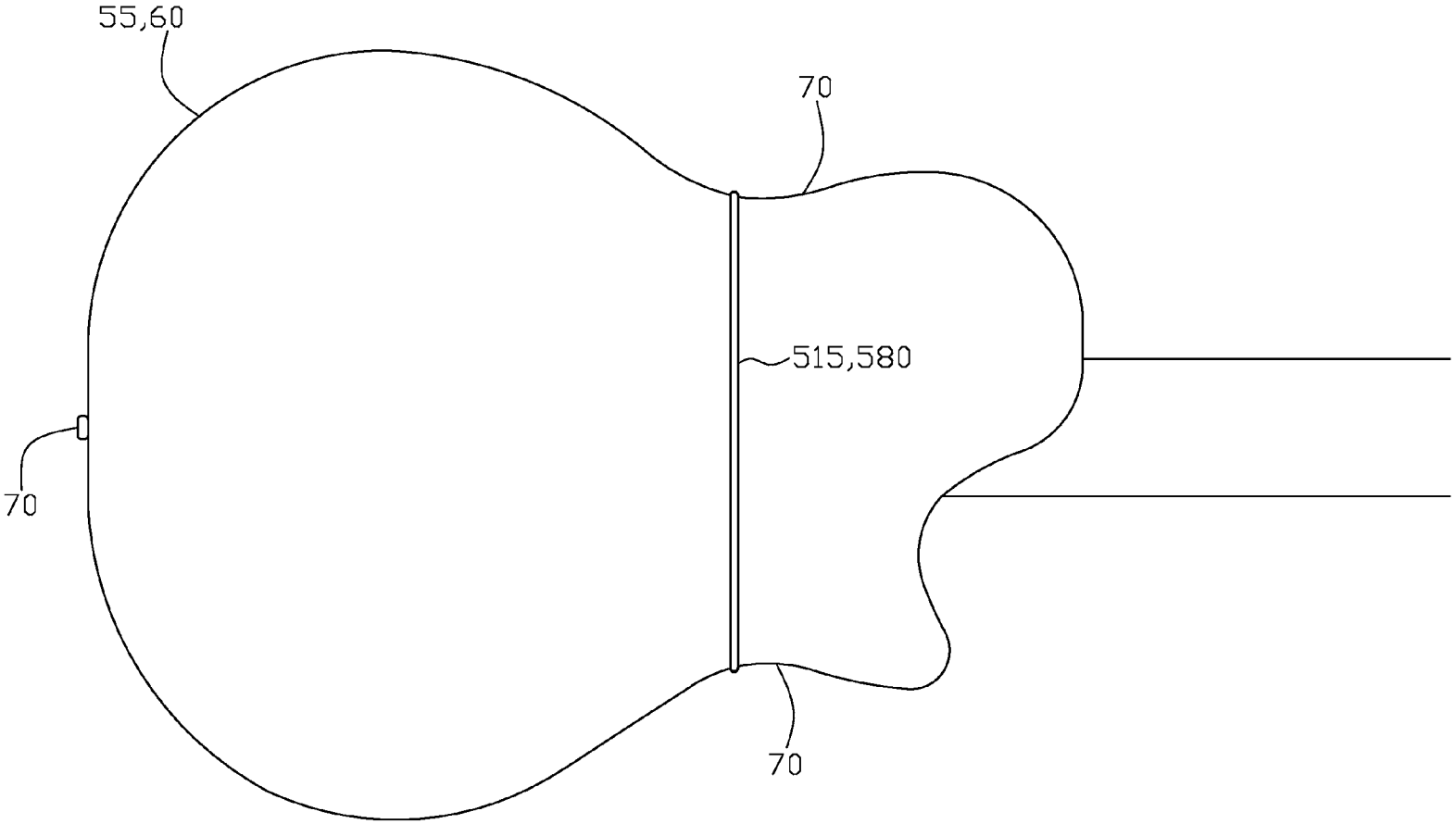
FIG. 20 shows a rear plan view of the musical instrument body as pertaining to the hidden side of the view shown in FIG. 19, wherein the tie is shown with the coil removably engaging the opposing body retention features of the musical instrument body.
Figure 21:
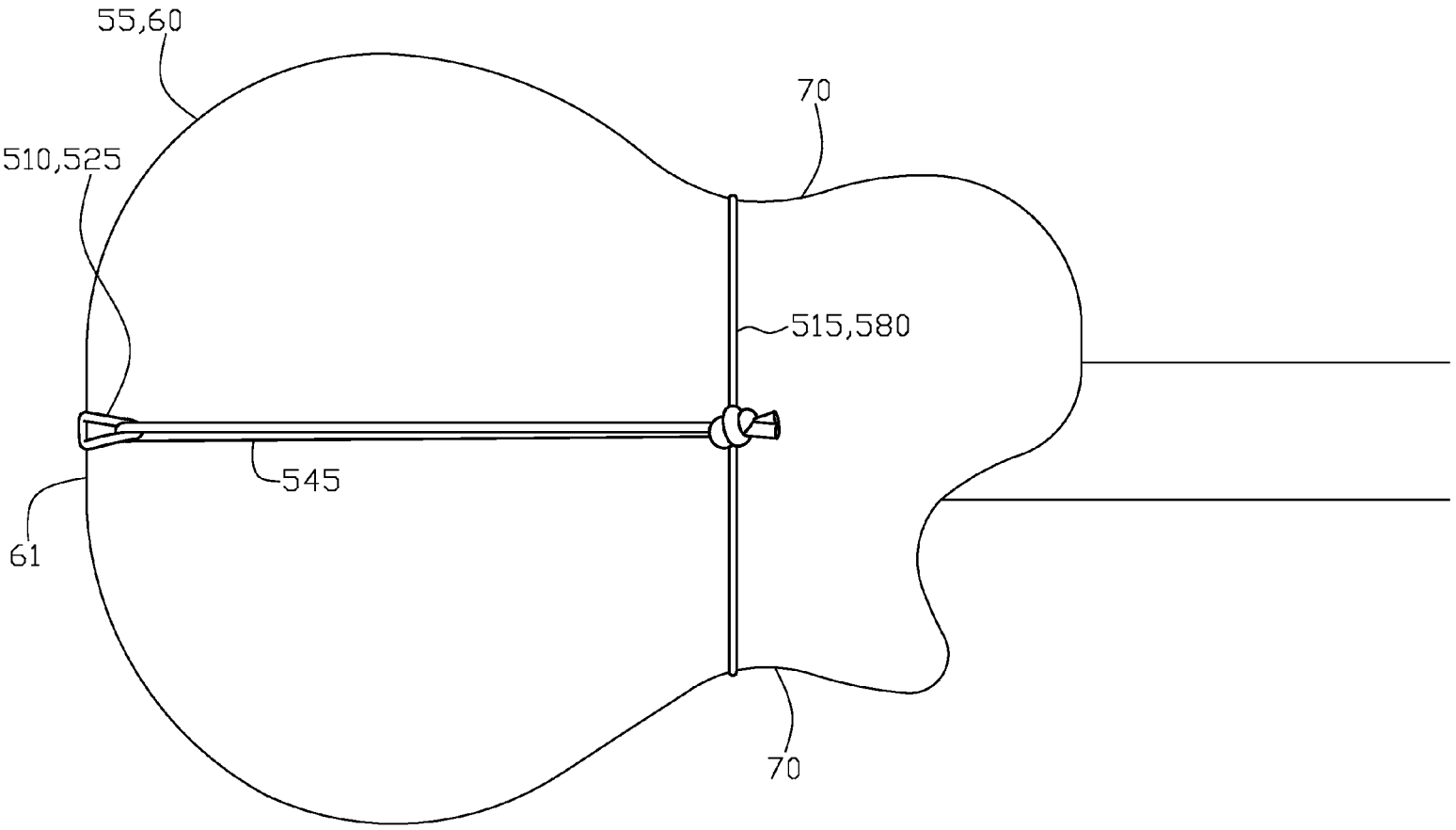
FIG. 21 shows a rear plan view of the musical instrument body also as pertaining to the hidden side of the view shown in FIG. 19, wherein the tie is shown with the coil removably engaging the opposing body retention features of the musical instrument body in addition to the lanyard and the noose attaching to the coil of the tie when there is not a rear body retention feature on the musical instrument.

Further, FIG. 20 shows a rear plan view of the musical instrument 55 body 60 as pertaining to the hidden side of the view shown in FIG. 19, wherein the tie 510 is shown with the coil 580 removably engaging the opposing body retention features 70 of the musical instrument 55 body 60. Next, FIG. 21 shows a rear plan view of the musical instrument 55 body 60 also as pertaining to the hidden side of the view shown in FIG. 19, wherein the tie 510 is shown with the coil 580 removably engaging the opposing body retention features 70 of the musical instrument 55 body 60 in addition to the lanyard 525 and the noose 545 attaching to the coil 580 of the tie 510 when there is not a rear 61 body retention feature 70 on the musical instrument 55.

Figure 22:
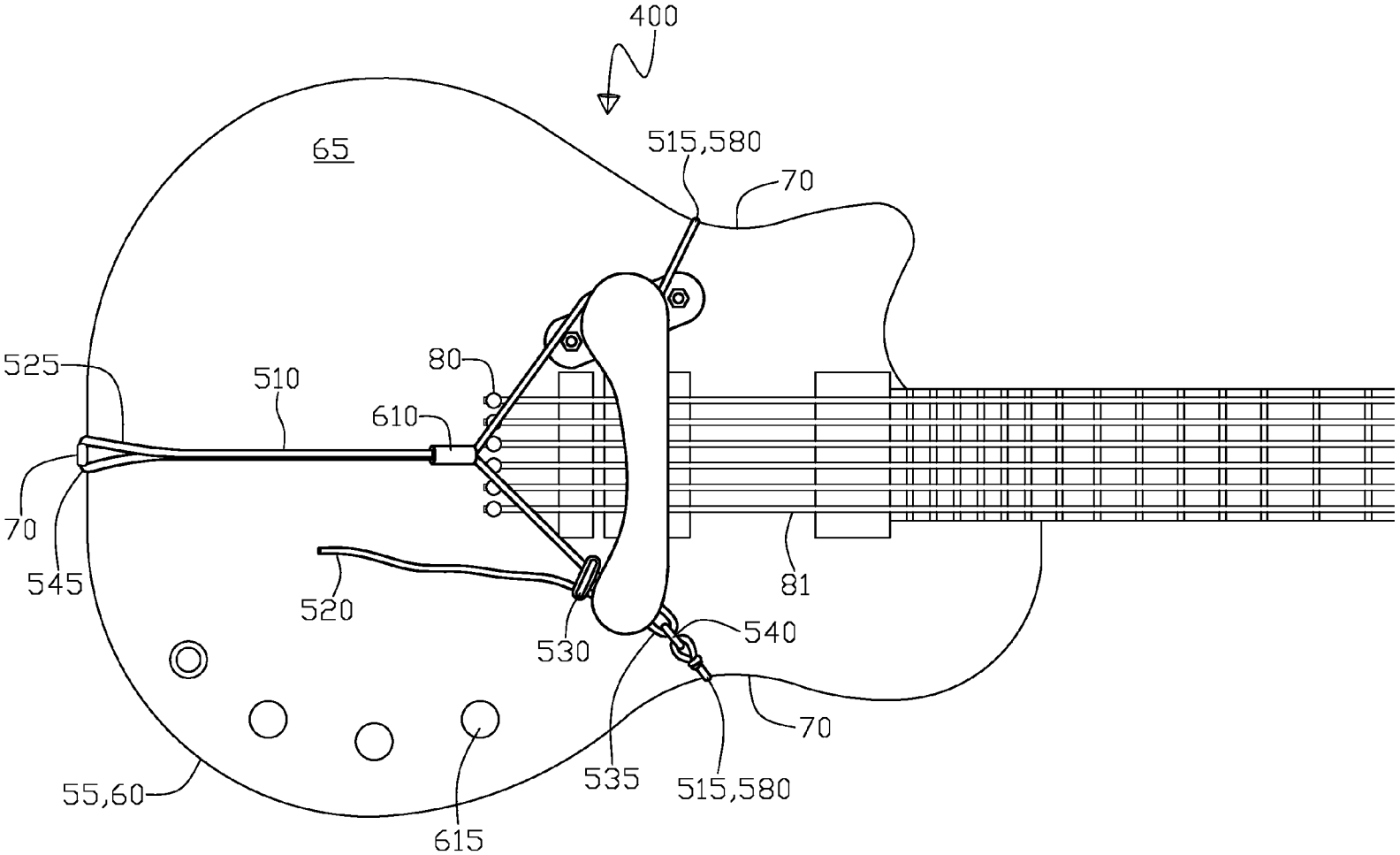
FIG. 22 shows a plan view of the first alternative embodiment of the hand support apparatus installed upon the musical instrument that is in the form of an electric guitar, wherein the hand support apparatus is positioned ahead of the string retention bridge with the tie coil and lanyard removably engaging opposing body retention features of the musical instrument in effect holding down the hand support apparatus to the prime surface of the musical instrument body without any permanent markings or openings disposed on the musical instrument, wherein the hand support apparatus is removable from the musical instrument, wherein the beam principal surface supports a user's hand over or adjacent to the musical instrument string in the form of a scaffold that is non-contacting over the string for instrument playing.

Next, FIG. 22 shows a plan view of the first alternative embodiment 400 of the hand support apparatus installed upon the musical instrument 55 that is in the form of an electric guitar showing the volume knob 615, wherein the hand support apparatus 400 is positioned ahead of the string retention bridge 80 with the tie 510 coil 580 and lanyard 525 removably engaging opposing body retention features 70 of the musical instrument 55 in effect holding down the hand support apparatus 400 to the prime surface 65 of the musical instrument 55 body 60 without any permanent markings or openings disposed on the musical instrument 55. Thus in FIG. 22, the hand support apparatus 400 is removable from the musical instrument 55, wherein the beam 405 principal 425 surface supports a user's 82 hand over or adjacent to the musical instrument 55 string 81 in the form of a scaffold that is non-contacting over or adjacent to the string 81 for instrument 55 playing.

Figure 23:
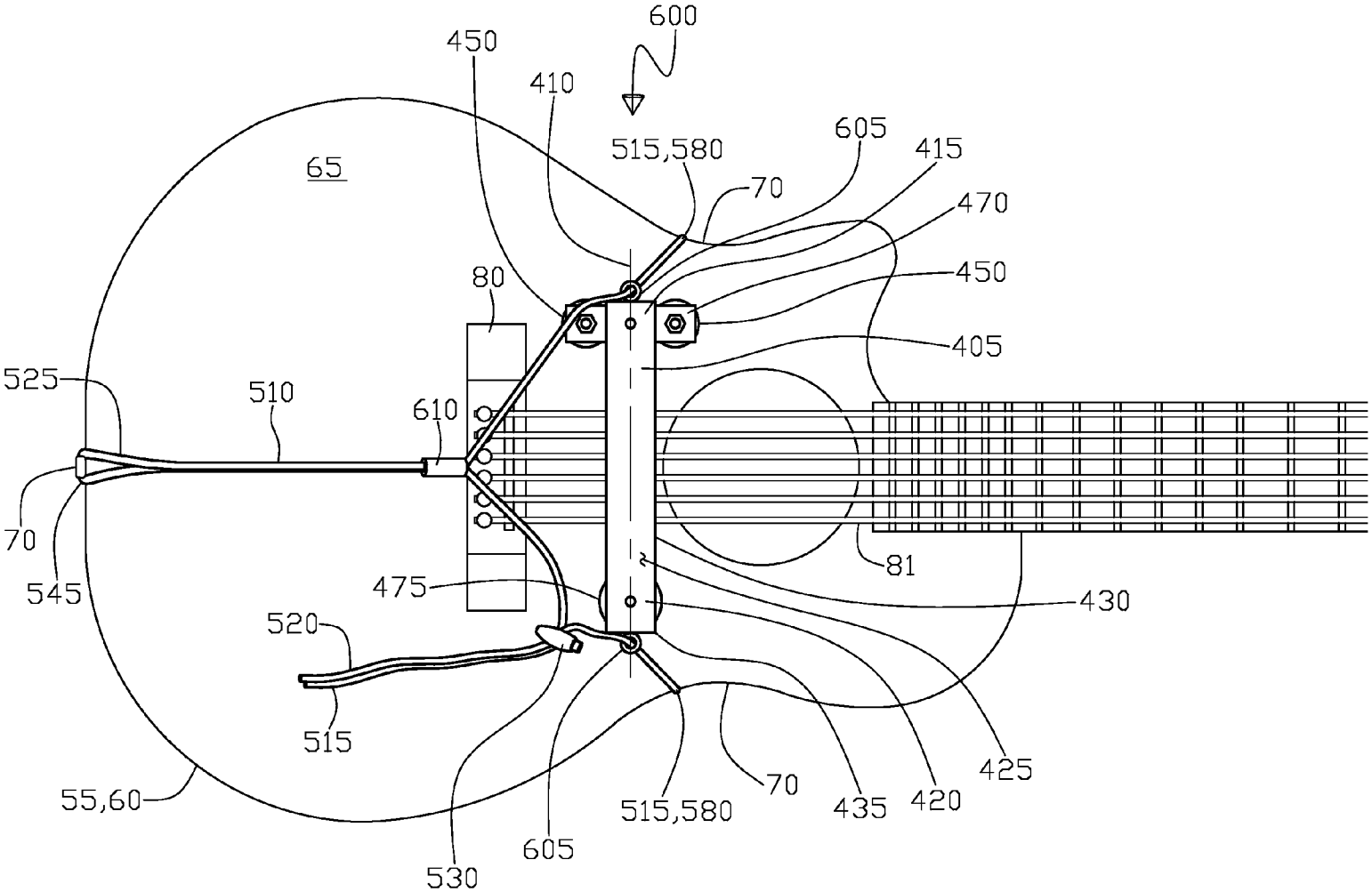
FIG. 23 shows a plan view of the second alternative embodiment of the hand support apparatus installed upon the musical instrument being positioned ahead of the string retention bridge with the tie coil and lanyard removably engaging opposing body retention features of the musical instrument in effect holding down the hand support apparatus to the prime surface of the musical instrument body without any permanent markings or openings disposed on the musical instrument, wherein the hand support apparatus is removable from the musical instrument, wherein the beam principal surface supports a user's hand over or adjacent to the musical instrument string in the form of a scaffold that is non-contacting over the string for instrument playing.

Further, FIG. 23 shows a plan view of the second alternative embodiment 600 of the hand support apparatus installed upon the musical instrument 55 being positioned ahead of the string retention bridge 80 with the tie 510 coil 580 and lanyard 525 removably engaging opposing body retention features 70 of the musical instrument 55 in effect holding down the hand support apparatus 600 to the prime surface 65 of the musical instrument 55 body 60 without any permanent markings or openings disposed on the musical instrument 55. As FIG. 23 shows, the hand support apparatus 600 is removable from the musical instrument 55, wherein the beam 405 principal surface 425 supports a user's 82 hand over the musical instrument 55 string 81 in the form of a scaffold that is non-contacting over the string 81 for instrument 55 playing.

Broadly, the present invention is shown in FIGS. 1 to 12 for the hand support apparatus 50 for the string musical instrument 55 having the body 60 that includes the prime surface 65, the body 60 including opposing retention features 70, 75, and the string retention bridge 80 disposed upon the prime surface 65 such that the string 81 is suspended away from the prime surface 65, as best shown in FIGS. 4 and 10. The hand support apparatus 50 includes the beam 85 having a longitudinal axis 90, the beam 85 having the first end portion 95 and an opposing second end portion 100 with the longitudinal axis 90 spanning therebetween the first end portion 95 and the second end portion 100, as best shown in FIGS. 1 and 2. The beam 85 further having the principal surface 105 and the opposing minor surface 110, wherein the principal surface 105 and the minor surface 110 span the beam 85 both being substantially parallel to the longitudinal axis 90, with the beam 85 also having the peripheral surface 115, again see FIGS. 1 and 2.

Further included in the hand support apparatus 50 is the first extension member 130 having the first axis 135, the first extension member 130 having the first proximal portion 140 and an opposing first distal portion 145 with the first axis 135 spanning therebetween the first proximal portion 140 and the first distal portion 145, the first extension member 130 also having the first perimeter surface 150, wherein the first proximal portion 155 is affixed to the beam 85 first end portion 95 on the minor surface 110, the first axis 135 is positioned substantially perpendicular 160 to the beam 85 longitudinal axis 90, as shown best in FIGS. 1 and 2.

In addition, included on the hand support apparatus 50 is a second extension member 165 having the second axis 170, the second extension member 165 having a second proximal portion 175 and an opposing second distal portion 180 with the second axis 170 spanning therebetween the second proximal portion 175 and the second distal portion 180, the second extension member 165 also having the second perimeter surface 185, wherein the second proximal portion 175 is affixed 190 to the beam 85 second end portion 100 on the minor surface 110, with the second axis 170 being positioned substantially perpendicular 195 to the beam 85 longitudinal axis 90, see FIGS. 1 and 2. Wherein the first axis 135 and the second axis 170 are positioned substantially parallel 200 to one another and the first extension member 130 and the second extension member 165 both extend away from the beam 85 in substantially a same direction, such that the first extension member 130, the beam 85, and the second extension member 165 form a "U" shape 205 termed an arch, with the arch having an arch axis 210, wherein the peripheral surface 115, the first perimeter surface 150, and the second perimeter surface 185 forming a flank surface 215, again see FIGS. 1 and 2.

Continuing, also included on the hand support apparatus 50 is the elastic finger 220 having the primary end portion 225 and an opposing secondary end portion 230, the primary end portion 225 is affixed 235 on one end to the flank surface 215 and the primary end portion 225 depends away from the principal surface 105 in a direction toward the first 130 and second 165 extension members on an opposing end of the primary end portion 225 having the means 245 for removable engaging the body 60 retention feature 70. The secondary end portion 230 is affixed 260 on one end to the flank surface 215 opposite of the primary end portion 225 and the secondary end portion 230 depends away from the principal surface 105 in a direction toward the first 130 and second 165 extension members on an opposing end of the secondary end portion 230 having the means 265 for removable engagement to an opposing body 60 retention feature 75, again see FIGS. 1 and 2. Wherein operationally, the first 145 and second 180 distal portions are drawn to be adjacent to the prime surface 65 via the elastic finger 220 with the minor surface 110 forming a non-contacting scaffold 270 over the string 81 and the principal surface 105 forming a hand rest 275 for a player 82 of the string musical instrument 55, wherein the hand support apparatus 50 is removably engagable to the string musical instrument 55, see in particular FIG. 7, also FIGS. 3 to 6, and 8 to 10.

Alternatively, the hand support apparatus 50 can further comprise a plurality of the elastic fingers 220 that are each positioned in a spaced apart manner 280 along the arch axis 210, for the operational purpose of symmetric hold down loading of the hand support apparatus 50 as against the prime surface 65, as shown in particular in FIGS. 1 and 2, plus in FIGS. 3, 5, 6, 8, and 9. In addition, alternatively for the hand support apparatus 50 wherein the elastic finger 220 primary end portion 225 and the elastic finger 220 secondary end portion 230 can be affixed 285 to the peripheral surface 115, see in particular FIGS. 1 and 2.

Also optionally, on the hand support apparatus 50 the elastic finger 220 primary end portion 225 and the elastic finger 220 secondary end portion 230 are affixed 290 to the first perimeter surface 150, as best shown in FIG. 12. Further optionally, on the hand support apparatus 50 the elastic finger 220 primary end portion 225 and the elastic finger 220 secondary end portion 230 are affixed 290 to the second perimeter surface 185, also as best shown in FIG. 12.

Another option, on the hand support apparatus 50 the means 265 for removable engaging the body 60 opposing retention feature 75 is preferably constructed of a loop 250 of the elastic finger 220 that removably engages the body 60 opposing retention feature 75, see FIGS. 1, 2, 5, 6, 8, 9, and 12. Yet another option, on the hand support apparatus 50 the means 245 for removable engaging the body 60 retention feature 70 is preferably constructed of a malleable soft surface "S" hook 255 that is sized and configured to removably engage the body retention feature 70, as best shown in FIGS. 1, 2, 3, 4, 5, 6, 7, 8, 10, 11, and 12. Further, on the hand support apparatus 50 the first 130 and second 165 extension members are preferably constructed of a pliable material to firstly not damage or mark the prime surface 65 and to provide a higher degree of friction as between the first 130 and second 165 extension members and particularly the first 145 and second 180 distal portions and the prime surface 65 for securing the hand support apparatus 50 to the string musical instrument 55.

For the hand support apparatus 50, as best shown in FIGS. 4 and 10, optionally included is a cavity 120 disposed within the beam 85 between the principal 105 and minor 110 surfaces, wherein the elastic finger 220 having the primary end portion 225 and the opposing secondary end portion 230, is disposed therethrough the cavity 120 in a slidable engagement 300 such that the primary end portion 225 extends from the beam 85 and the secondary end portion 230 extends from an opposing side of the beam 85. The primary end portion 225 depends away from the principal surface 105 in a direction toward the first 130 and second 165 extension members to a primary terminal end portion 240 that has a means 245 for removable engaging the body retention feature 70, the secondary end portion 230 depends away from the principal surface 105 in a direction toward the first 130 and second 165 extension members to a second terminal end portion 241 that has a means 265 for removable engagement to an opposing body 60 retention feature 75. Wherein operationally, the first 145 and second 180 distal portions are drawn to be adjacent to the prime surface 65 via the elastic finger 220 with the minor surface 110 forming a non-contacting scaffold 270 over the string 81 and the principal surface 105 forming a hand rest 275 for a player 82 of the string musical instrument 55, wherein the hand support apparatus 50 is removably engagable to the string musical instrument 55. The slidable engagement allows the elastic finger 220 to be a single piece as between the primary end portion 225 and the opposing secondary end portion 230 for simpler construction.

Further optionally, on the hand support apparatus 50 the beam 85 can further comprises a plurality of cavities 120 and that are each positioned in a substantially parallel spaced apart manner 125 along the longitudinal axis 90 and further comprising a plurality of the elastic fingers 220 that are each positioned therethrough each of the cavities 120 resulting in the elastic fingers being in a spaced apart manner 280 along the longitudinal axis 90, see FIGS. 1 to 10, operationally for the purpose of symmetric hold down loading of the hand support apparatus 50 as against the prime surface 65, as shown in particular in FIGS. 1 and 2, plus in FIGS. 3, 5, 6, 8, and 9.

For the alternative embodiment of the hand support apparatus 50, as best shown in FIG. 11, via not having attachment of the elastic fingers 220 to the beam 85 or first 130 or second 165 extension members, utilizes a pair of elastic fingers termed an initial elastic finger 305 and a following elastic finger 320, each having primary end portions 310, 325 and opposing secondary end portions 315, 330 wherein the initial primary end portion 310 is adjacent to and in contact with the peripheral surface 115 and the initial primary end portion 310 depends away from the principal surface 105 in a direction toward the first distal portion 145 on an opposing end of the initial primary end portion 310 having a means 245 for removably engaging a body 60 retention feature 70. The initial secondary end portion 315 is adjacent to and in contact with the peripheral surface 115 opposite of the initial primary end portion 310 and the initial secondary end portion 315 depends away from the principal surface 105 in a direction toward the first distal portion 145 on an opposing end of the initial secondary end portion 315 having a means 265 for removable engagement to an opposing body 60 retention feature 75.

Further, FIG. 11 shows the following primary end portion 325 being adjacent to and in contact with an opposing end of the peripheral surface 115 and the following primary end portion 325 depends away from the principal surface 105 in a direction toward the second distal portion 180 on an opposing end of the following primary end portion 325 having a means 245 for removable engaging a body 60 retention feature 70. The following secondary end portion 330 is adjacent to and in contact with the opposing end of the peripheral surface 115 opposite of the following primary end portion 325 and the following secondary end portion 330 depends away from the principal surface 105 in a direction toward the second distal portion 180 on an opposing end of the following secondary end portion 330 having the means 265 for removable engagement to an opposing body 60 retention feature 75.

Wherein operationally, as shown in FIG. 11 the first 145 and second 180 distal portions are drawn to be adjacent to the prime surface 65 via the pair of elastic fingers 305, 320 pulling the first 130 and second 165 extension members toward one another and toward the prime surface 65 with the minor surface 110 forming a non-contacting scaffold 270 over the string 81 and the principal surface 105 forming a hand rest 275 for a player 82 of the string musical instrument 55, see FIG. 7, wherein the hand support apparatus 50 is removably engagable to the string musical instrument 55.

Focusing on FIGS. 13 through 23 and in particular FIGS. 13-16, the hand support apparatus 400 being termed the first alternative embodiment for the string musical instrument 55 has the body 60 that includes the prime surface 65, the body 60 including retention features 70, and the string retention bridge 80 is disposed upon the prime surface 65 such that the string 81 is suspended away from the prime surface 65. The hand support apparatus 400 includes the beam 405 having the longitudinal axis 410, with the beam 405 having the first end portion 415 and the opposing second end portion 420 with the longitudinal axis 410 spanning therebetween the first end portion 415 and the second end portion 420. The beam 405 further having a principal surface 425 and an opposing minor surface 430, wherein the principal surface 425 and the minor surface 430 span the beam 405 both being substantially parallel to the longitudinal axis 410, the beam 405 also having a peripheral surface 435, with the beam 405 first end portion 415 having a first aperture 500 disposed therethrough on the peripheral surface 435 that is positioned between the principal surface 425 and the minor surface 430. The beam 405 second end portion 420 further having a plurality of second apertures 505 disposed therethrough on the peripheral surface 435 that are positioned between the principal surface 425 and the minor surface 430.

Further included in the hand support apparatus 400 are the plurality of first extension members 450 each having the first axis 455, the first extension members 450 each having the first proximal portion 460 and the opposing first distal portion 465 with the first axis 455 spanning therebetween the first proximal portion 460 and the first distal portion 465. Wherein the plurality of first extension members 450 are spaced apart on a branch 470 that is attached to the beam 405 first end portion 415 on the minor surface 430. The plurality of first extension members 450 are positioned on the branch 470 to opposingly straddle the beam 405 first end portion 415 wherein each first axis 455 is positioned substantially perpendicular to the beam longitudinal axis 410, see FIG. 14.

Also included in the hand support apparatus 400 is the second extension member 475 having the second axis 480, the second extension member 475 having the second proximal portion 485 and the opposing second distal portion 490 with the second axis 480 spanning therebetween the second proximal portion 485 and the second distal portion 490. The second proximal portion 485 is affixed to the beam 405 second end portion 420 on the minor surface 430, the second axis 480 is positioned substantially perpendicular to the beam 405 longitudinal axis 410, wherein each first axis 455 and second axis 480 are positioned substantially parallel to one another and plurality of first extension members 450 and the second extension member 475 both extend away from the beam 405 in substantially a same direction, such that the plurality of first extension members 450, the beam 405, and the second extension member 475 form a "U" shape termed an arch 495, see FIG. 14.

In addition, included in the hand support apparatus 400 is the flexible tie 510 having the primary end portion 515 and the opposing secondary end portion 520, the primary end portion 515 is threaded therethrough the first aperture 500 and affixed to the means for removably engaging 245 the body retention feature 70. The primary end portion 515 depends away from the peripheral surface 435, the secondary end portion 520 extends from the primary end portion 515 for the secondary portion 520 to form the lanyard 525 that extends to be threaded therethrough the means for cinching 530 and one of the second apertures 505 forming the hoop 535 and continuing to be threaded therethrough another one of the second apertures 505 and further continuing to be threaded therethrough the means for cinching 530, see in particular FIGS. 13 and 14. The hoop 535 is slidably engaged to a ring 540, wherein the ring 540 is affixed to a means for removably engaging 245 the body retention feature 70. Wherein operationally the first 465 and second 490 distal portions are drawn to be adjacent to the prime surface 65 via the flexible tie 510 with the minor surface 430 "U" shape arch 495 forming a non-contacting scaffold over the string 81 and the principal surface 425 forming a hand rest for a player 82 of the string musical instrument 55.

Wherein the hand support apparatus 400 is removably engagable to the string musical instrument 55, the hand support apparatus 400 is engaged to the string musical instrument 55 via manually pulling on the tie 510 secondary end portion 520 with the means for cinching 530 released and the means for removably engaging 245 the body 60 retention feature 70 are engaged to opposing body retention features 70 with the lanyard 525 engaged to another opposing body retention feature 70 wherein when the tie 510 is manually brought taut wherein then the means for cinching 530 is engaged to grip the tie 510 thus securing removably the hand support apparatus 400 to the musical instrument 55.

Optionally, for the hand support apparatus 400, the lanyard 525 can further include an attached noose 545 that is operational to be engaged to the other opposing body retention feature 70, see FIGS. 13, 15, and 16. Further, optionally on the hand support apparatus 400 wherein the means for removable engagement 245 to the body retention feature 70 is preferably constructed of a malleable soft surface hook 255 that is sized and configured to removably engage the body retention feature 70, see FIGS. 13, 14, and 15.

Another option for the hand support apparatus 400 can further include an annular channel 550, wherein the channel 550 has an interior section 555 and an exterior surface 560, also the annular channel 550 has a pair of protrusions 565 that are spaced apart and disposed on the exterior surface 560, the annular channel 550 conforms to the body retention feature 70 that is in the form of a sound hole 570 with the annular channel 550 conforming to a margin 575 of the sound hole 570, wherein the hook 255 engages an intersection of the protrusion 565 and the exterior surface 560, being operational to protect the sound hole 570 margin 575, see FIG. 15.

Yet another option for the hand support apparatus 400 can further include a spar 585 that has a pair of spirals 590 that each have an inner third aperture 595, wherein the spirals 590 are spaced apart and opposing one another, the spirals 590 removably engage the body retention feature 70 that is in the form of a sound hole 570 with each spiral 590 conformingly wedging over a portion of the margin 575 of the sound hole 570, wherein each means for removably engaging 245 the body retention feature 70, removably engages each said inner third aperture 595, wherein operationally the spar 585 provides a removable engagement point for the sound hole 570 margin 575, see FIG. 16. Another option for the hand support apparatus 400 wherein the first 450 and second 475 extension members are preferably constructed of a pliable material, see FIGS. 13, 14, 15, and 16. Yet another option for the hand support apparatus 400 can further include a friction sleeve 610 that is slidably engaged to the lanyard 525 to further secure the lanyard 525 to the body retention feature 70, see FIGS. 13, 14, 19, and 22.

Focusing on FIGS. 13 through 23 and in particular FIGS. 17-22, the hand support apparatus 400 being termed the first alternative embodiment for the string musical instrument 55 has the body 60 that includes the prime surface 65, the body 60 including retention features 70, and the string retention bridge 80 is disposed upon the prime surface 65 such that the string 81 is suspended away from the prime surface 65. The hand support apparatus 400 includes the beam 405 having the longitudinal axis 410, with the beam 405 having the first end portion 415 and the opposing second end portion 420 with the longitudinal axis 410 spanning therebetween the first end portion 415 and the second end portion 420. The beam 405 further having a principal surface 425 and an opposing minor surface 430, wherein the principal surface 425 and the minor surface 430 span the beam 405 both being substantially parallel to the longitudinal axis 410, the beam 405 also having a peripheral surface 435, with the beam 405 first end portion 415 having a first aperture 500 disposed therethrough on the peripheral surface 435 that is positioned between the principal surface 425 and the minor surface 430. The beam 405 second end portion 420 further having a plurality of second apertures 505 disposed therethrough on the peripheral surface 435 that are positioned between the principal surface 425 and the minor surface 430.

Further included in the hand support apparatus 400 are the plurality of first extension members 450 each having the first axis 455, the first extension members 450 each having the first proximal portion 460 and the opposing first distal portion 465 with the first axis 455 spanning therebetween the first proximal portion 460 and the first distal portion 465. Wherein the plurality of first extension members 450 are spaced apart on a branch 470 that is attached to the beam 405 first end portion 415 on the minor surface 430. The plurality of first extension members 450 are positioned on the branch 470 to opposingly straddle the beam 405 first end portion 415 wherein each first axis 455 is positioned substantially perpendicular to the beam longitudinal axis 410.

Also included in the hand support apparatus 400 is the second extension member 475 having the second axis 480, the second extension member 475 having the second proximal portion 485 and the opposing second distal portion 490 with the second axis 480 spanning therebetween the second proximal portion 485 and the second distal portion 490. The second proximal portion 485 is affixed to the beam 405 second end portion 420 on the minor surface 430, the second axis 480 is positioned substantially perpendicular to the beam 405 longitudinal axis 410, wherein each first axis 455 and second axis 480 are positioned substantially parallel to one another and plurality of first extension members 450 and the second extension member 475 both extend away from the beam 405 in substantially a same direction, such that the plurality of first extension members 450, the beam 405, and the second extension member 475 form a "U" shape termed an arch 495, see FIG. 14.

Further included in the hand support apparatus 400 is a flexible tie 510 having a primary end portion 515 and an opposing secondary end portion 520, the primary end portion 515 is threaded therethrough the first aperture 500 and affixed to a ring 540, wherein the primary end portion 515 depends away from the peripheral surface 435 forming a coil 580, see FIGS. 17 and 18. The secondary end portion 520 extends from the primary end portion 515 for the secondary portion 520 to form a lanyard 525 that extends to be threaded therethrough a means for cinching 530 and one of the second apertures 505 forming a hoop 535 and continuing to be threaded therethrough another one of the second apertures 505 and further continuing to be threaded therethrough the means for cinching 530, the hoop 535 is slidably engaged to the ring 540, again see FIGS. 17 and 18.

Wherein operationally, the first 465 and second 490 distal portions are drawn to be adjacent to the prime surface 65 via the flexible tie 510 with the minor surface "U" shape arch 495 forming a non-contacting scaffold over the string 81 and the principal surface 425 forming a hand rest for a player 82 of the string musical instrument 55. Wherein the hand support apparatus 400 is removably engagable to the string musical instrument 81, the hand support apparatus 400 is engaged to the string musical instrument 81 via manually pulling on the tie 510 secondary end portion 520 with the means for cinching 530 released and the coil 580 removably engaging a body retention feature 70 with the lanyard 525 engaged to another opposing body retention feature 70 wherein when the tie 510 is manually brought taut wherein then the means for cinching 530 is then engaged to grip the tie 510, see FIGS. 19-22.

Optionally, for the hand support apparatus 400, the lanyard 525 can further include an attached noose 545 that is operational to be engaged to the other opposing body retention feature 70, see FIGS. 17, 19, 21, and 22. Further, the noose 545 can be removably engaged to the lanyard 525, being operational to engage the hand support apparatus 400 to the musical instrument 55 when there is no body retention feature 70 disposed on a rear portion 61 of the body 60 of the musical instrument 55, see FIG. 21. Another option for the hand support apparatus 400 wherein the first 450 and second 475 extension members are preferably constructed of a pliable material, see FIGS. 17, 18, 19, and 22. Yet another option for the hand support apparatus 400 can further include a friction sleeve 610 that is slidably engaged to the lanyard 525 to further secure the lanyard 525 to the body retention feature 70, see FIGS. 17, 18, 19, and 22.

Referencing in particular to FIG. 23 for a second alternative embodiment 600 of the hand support apparatus for the string musical instrument 55 having the body 60 that includes the prime surface 65, the body 60 including retention features 70, and the string retention bridge 80 disposed upon the prime surface 65 such that the string 81 is suspended away from the prime surface 65. The hand support apparatus 600 includes a beam 405 having a longitudinal axis 410, the beam 405 having a first end portion 415 and an opposing second end portion 420 with the longitudinal axis 410 spanning therebetween the first end portion 415 and the second end portion 420, the beam 405 further having a principal surface 425 and an opposing minor surface 430. Wherein the principal surface 425 and the minor surface 430 span the beam 405 both being substantially parallel to the longitudinal axis 410, the beam 405 also having a peripheral surface 435, further the beam 405 having a pair of protruding eyelets 605 that are disposed on the peripheral surface 435, wherein the eyelets 605 are positioned opposite from one another being adjacent to the first 415 and second 420 end portions respectively, as shown in FIG. 23.

Further included in the hand support apparatus 600 are the plurality of first extension members 450 each having the first axis 455, the first extension members 450 each having the first proximal portion 460 and the opposing first distal portion 465 with the first axis 455 spanning therebetween the first proximal portion 460 and the first distal portion 465. Wherein the plurality of first extension members 450 are spaced apart on a branch 470 that is attached to the beam 405 first end portion 415 on the minor surface 430. The plurality of first extension members 450 are positioned on the branch 470 to opposingly straddle the beam 405 first end portion 415 wherein each first axis 455 is positioned substantially perpendicular to the beam longitudinal axis 410.

Also included in the hand support apparatus 600 is the second extension member 475 having the second axis 480, the second extension member 475 having the second proximal portion 485 and the opposing second distal portion 490 with the second axis 480 spanning therebetween the second proximal portion 485 and the second distal portion 490. The second proximal portion 485 is affixed to the beam 405 second end portion 420 on the minor surface 430, the second axis 480 is positioned substantially perpendicular to the beam 405 longitudinal axis 410, wherein each first axis 455 and second axis 480 are positioned substantially parallel to one another and plurality of first extension members 450 and the second extension member 475 both extend away from the beam 405 in substantially a same direction, such that the plurality of first extension members 450, the beam 405, and the second extension member 475 form a "U" shape termed an arch 495, see FIGS. 14 and 23, wherein the second alternative embodiment 600 is as shown in FIG. 23, however, the first 450 and second 475 extension members, including the branch 470 only are also as shown in FIG. 14 for an opposing view to FIG. 23.

Further included in the hand support apparatus 600 is a flexible tie 510 having a primary end portion 515 and an opposing secondary end portion 520, the primary end portion 515 is threaded therethrough the eyelet 605 adjacent to the first end portion 415 wherein the primary end portion 515 depends away from the peripheral surface 435 forming a coil 580, continuing, the primary end portion 515 is threaded therethrough the eyelet 605 adjacent to the second end portion 420 thereby continuing therethrough a means for cinching 530, the secondary end portion 520 extends from the primary end portion 515 that is adjacent to the first end portion 415 for the secondary portion 420 to form a lanyard 525 that extends to be threaded therethrough the means for cinching 530, as shown in FIG. 23.

Wherein operationally, the first 465 and second 490 distal portions are drawn to be adjacent to the prime surface 65 via the flexible tie 510 with the minor surface "U" shape arch 495 forming a non-contacting scaffold over the string 81 and the principal surface 425 forming a hand rest for a player 82 of the string musical instrument 55, wherein the hand support apparatus 600 is removably engagable to the string musical instrument 55, the hand support apparatus 600 is engaged to the string musical instrument 55 via manually pulling on either the tie 510 primary 515 or secondary 520 end portions with the means for cinching 530 released and the coil 580 removably engaging a body 60 retention feature 70 with the lanyard 525 engaged to another opposing body 60 retention feature 70, wherein when the tie 510 is manually brought taut wherein then the means for cinching 530 is then engaged to grip the tie 510, again as shown in FIG. 23 to secure the hand support apparatus 600 to the musical instrument 55.

Optionally, for the hand support apparatus 600, the lanyard 525 can further include an attached noose 545 that is operational to be engaged to the other opposing body retention feature 70, see FIGS. 20, 21, and 23. Further, the noose 545 can be removably engaged to the lanyard 525, being operational to engage the hand support apparatus 600 to the musical instrument 55 when there is no body retention feature 70 disposed on a rear portion 61 of the body 60 of the musical instrument 55, see FIG. 21. Another option for the hand support apparatus 600 wherein the first 450 and second 475 extension members are preferably constructed of a pliable material, as shown in FIG. 23, however, the first 450 and second 475 extension members only are also as shown in FIG. 14 for an opposing view to FIG. 23. Yet another option for the hand support apparatus 600 can further include a friction sleeve 610 that is slidably engaged to the lanyard 525 to further secure the lanyard 525 to the body retention feature 70, see FIG. 23.

CONCLUSION

Accordingly, the present invention of a string musical instrument hand support apparatus has been described with some degree of particularity directed to the embodiments of the present invention. It should be appreciated, though; that the present invention is defined by the following claims construed in light of the prior art so modifications or changes may be made to the exemplary embodiments of the present invention without departing from the inventive concepts contained therein.

The invention claimed is:

1. A hand support apparatus for a string musical instrument having a body that includes a prime surface, the body including retention features, and a string retention bridge disposed upon the prime surface such that a string is suspended away from the prime surface, said hand support apparatus comprising:

(a) a beam having a longitudinal axis, said beam having a first end portion and an opposing second end portion with said longitudinal axis spanning therebetween said first end portion and said second end portion, said beam further having a principal surface and an opposing minor surface, wherein said principal surface and said minor surface span said beam both being substantially parallel to said longitudinal axis, said beam also having a peripheral surface, said beam first end portion having an first aperture disposed therethrough on said peripheral surface that is positioned between said principal surface and said minor surface, said beam second end portion further having a plurality of second apertures disposed therethrough on said peripheral surface that are positioned between said principal surface and said minor surface;

(b) a plurality of first extension members each having a first axis, said first extension members each having a first proximal portion and an opposing first distal portion with said first axis spanning therebetween said first proximal portion and said first distal portion, said plurality of first extension members are spaced apart on a branch that is attached to said beam first end portion on said minor surface, said plurality of first extension members are positioned on said branch to opposingly straddle said beam first end portion wherein each said first axis is positioned substantially perpendicular to said beam longitudinal axis;

(c) a second extension member having a second axis, said second extension member having a second proximal portion and an opposing second distal portion with said second axis spanning therebetween said second proximal portion and said second distal portion, said second proximal portion is affixed to said beam second end portion on said minor surface, said second axis is positioned substantially perpendicular to said beam longitudinal axis, wherein said each said first axis and said second axis are positioned substantially parallel to one another and said plurality of first extension members and said second extension member both extend away from said beam in substantially a same direction, such that said plurality of first extension members, said beam, and said second extension member form a "U" shape termed an arch; and (d) a flexible tie having a primary end portion and an opposing secondary end portion, said primary end portion is threaded therethrough said first aperture and affixed to a means for removably engaging a body retention feature, wherein said primary end portion depends away from said peripheral surface, said secondary end portion extends from said primary end portion for said secondary portion to form a lanyard that extends to be threaded therethrough a means for cinching and one of said second apertures forming a hoop and continuing to be threaded therethrough another one of said second apertures and further continuing to be threaded therethrough said means for cinching, said hoop is slidably engaged to a ring, wherein said ring is affixed to a means for removably engaging a body retention feature, wherein operationally said first and second distal portions are drawn to be adjacent to the prime surface via said flexible tie with said minor surface "U" shape arch forming a non-contacting scaffold over or adjacent to the string and said principal surface forming a hand rest for a player of the string musical instrument, wherein said hand support apparatus is removably engagable to the string musical instrument, said hand support apparatus is engaged to the string musical instrument via manually pulling on said tie secondary end portion with said means for cinching released and said means for removably engaging a body retention feature are engaged to opposing body retention features with said lanyard engaged to another opposing body retention feature wherein when the tie is manually brought taut wherein then said means for cinching is engaged to grip said tie to removably secure said hand support apparatus to the musical instrument.

2. A hand support apparatus for a string musical instrument according to claim 1 wherein said lanyard further includes an attached noose that is operational to be engaged to the other opposing body retention feature.

3. A hand support apparatus for a string musical instrument according to claim 1 wherein said means for removable engagement to the body retention feature is constructed of a malleable soft surface hook that is sized and configured to removably engage the body retention feature.

4. A hand support apparatus for a string musical instrument according to claim 3 further including an annular channel, wherein said channel has an interior section and an exterior surface, also said annular channel has a pair of protrusions that are spaced apart and disposed on said exterior surface, said annular channel conforms to the body retention feature that is in the form of a sound hole with said annular channel conforming to a margin of the sound hole, wherein said hook engages an intersection of said protrusion and said exterior surface, being operational to protect the sound hole margin.

5. A hand support apparatus for a string musical instrument according to claim 1 further including a spar that has a pair of spirals that each have an inner third aperture, wherein said spirals are spaced apart and opposing one another, said spirals removably engage the body retention feature that is in the form of a sound hole with said each said spiral conformingly wedging over a portion of a margin of the sound hole, wherein each said means for removably engaging a body retention feature removably engaging engages each said inner third aperture, wherein operationally said spar provides a removable engagement point for the sound hole margin.

6. A hand support apparatus for a string musical instrument according to claim 1 wherein said first and second extension members are constructed of a pliable material.

7. A hand support apparatus for a string musical instrument according to claim 1 wherein said lanyard further includes a friction sleeve that is slidably engaged to said lanyard to further secure said lanyard to the body retention feature.

8. A hand support apparatus for a string musical instrument having a body that includes a prime surface, the body including retention features, and a string retention bridge disposed upon the prime surface such that a string is suspended away from the prime surface, said hand support apparatus comprising:

(a) a beam having a longitudinal axis, said beam having a first end portion and an opposing second end portion with said longitudinal axis spanning therebetween said first end portion and said second end portion, said beam further having a principal surface and an opposing minor surface, wherein said principal surface and said minor surface span said beam both being substantially parallel to said longitudinal axis, said beam also having a peripheral surface, said beam first end portion having an first aperture disposed therethrough on said peripheral surface that is positioned between said principal surface and said minor surface, said beam second end portion further having a plurality of second apertures disposed therethrough on said peripheral surface that are positioned between said principal surface and said minor surface;

(b) a plurality of first extension members each having a first axis, said first extension members each having a first proximal portion and an opposing first distal portion with said first axis spanning therebetween said first proximal portion and said first distal portion, said plurality of first extension members are spaced apart on a branch that is attached to said beam first end portion on said minor surface, said plurality of first extension members are positioned on said branch to opposingly straddle said beam first end portion wherein each said first axis is positioned substantially perpendicular to said beam longitudinal axis;

(c) a second extension member having a second axis, said second extension member having a second proximal portion and an opposing second distal portion with said second axis spanning therebetween said second proximal portion and said second distal portion, said second proximal portion is affixed to said beam second end portion on said minor surface, said second axis is positioned substantially perpendicular to said beam longitudinal axis, wherein said each said first axis and said second axis are positioned substantially parallel to one another and said plurality of first extension members and said second extension member both extend away from said beam in substantially a same direction, such that said plurality of first extension members, said beam, and said second extension member form a "U" shape termed an arch; and (d) a flexible tie having a primary end portion and an opposing secondary end portion, said primary end portion is threaded therethrough said first aperture and affixed to a ring, wherein said primary end portion depends away from said peripheral surface forming a coil, said secondary end portion extends from said primary end portion for said secondary portion to form a lanyard that extends to be threaded therethrough a means for cinching and one of said second apertures forming a hoop and continuing to be threaded therethrough another one of said second apertures and further continuing to be threaded therethrough said means for cinching, said hoop is slidably engaged to said ring, wherein operationally said first and second distal portions are drawn to be adjacent to the prime surface via said flexible tie with said minor surface "U" shape arch forming a non-contacting scaffold over the string and said principal surface forming a hand rest for a player of the string musical instrument, wherein said hand support apparatus is removably engagable to the string musical instrument, said hand support apparatus is engaged to the string musical instrument via manually pulling on said tie secondary end portion with said means for cinching released and said coil removably engaging a body retention feature with said lanyard engaged to another opposing body retention feature wherein when said tie is manually brought taut wherein then said means for cinching is then engaged to grip said tie to removably secure said hand support apparatus to the musical instrument.

9. A hand support apparatus for a string musical instrument according to claim 8 wherein said lanyard further includes an attached noose that is operational to be engaged to the other opposing body retention feature.

10. A hand support apparatus for a string musical instrument according to claim 9 wherein said noose is removably engaged to said lanyard, being operational to engage said hand support apparatus to the musical instrument when there is no body retention feature disposed on a rear portion of the body of the musical instrument.

11. A hand support apparatus for a string musical instrument according to claim 8 wherein said first and second extension members are constructed of a pliable material.

12. A hand support apparatus for a string musical instrument according to claim 8 wherein said lanyard further includes a friction sleeve that is slidably engaged to said lanyard to further secure said lanyard to the body retention feature.

13. A hand support apparatus for a string musical instrument having a body that includes a prime surface, the body including retention features, and a string retention bridge disposed upon the prime surface such that a string is suspended away from the prime surface, said hand support apparatus comprising:

(a) a beam having a longitudinal axis, said beam having a first end portion and an opposing second end portion with said longitudinal axis spanning therebetween said first end portion and said second end portion, said beam further having a principal surface and an opposing minor surface, wherein said principal surface and said minor surface span said beam both being substantially parallel to said longitudinal axis, said beam also having a peripheral surface, further said beam having a pair of protruding eyelets that are disposed on said peripheral surface, wherein said eyelets are positioned opposite from one another being adjacent to said first and second end portions respectively;

(b) a plurality of first extension members each having a first axis, said first extension members each having a first proximal portion and an opposing first distal portion with said first axis spanning therebetween said first proximal portion and said first distal portion, said plurality of first extension members are spaced apart on a branch that is attached to said beam first end portion on said minor surface, said plurality of first extension members are positioned on said branch to opposingly straddle said beam first end portion wherein each said first axis is positioned substantially perpendicular to said beam longitudinal axis;

(c) a second extension member having a second axis, said second extension member having a second proximal portion and an opposing second distal portion with said second axis spanning therebetween said second proximal portion and said second distal portion, said second proximal portion is affixed to said beam second end portion on said minor surface, said second axis is positioned substantially perpendicular to said beam longitudinal axis, wherein said each said first axis and said second axis are positioned substantially parallel to one another and said plurality of first extension members and said second extension member both extend away from said beam in substantially a same direction, such that said plurality of first extension members, said beam, and said second extension member form a "U" shape termed an arch; and (d) a flexible tie having a primary end portion and an opposing secondary end portion, said primary end portion is threaded therethrough said eyelet adjacent to said first end portion wherein said primary end portion depends away from said peripheral surface forming a coil, continuing, said primary end portion is threaded therethrough said eyelet adjacent to said second end portion thereby continuing therethrough a means for cinching, said secondary end portion extends from said primary end portion that is adjacent to said first end portion for said secondary portion to form a lanyard that extends to be threaded therethrough said means for cinching, wherein operationally said first and second distal portions are drawn to be adjacent to the prime surface via said flexible tie with said minor surface "U" shape arch forming a non-contacting scaffold over the string and said principal surface forming a hand rest for a player of the string musical instrument, wherein said hand support apparatus is removably engagable to the string musical instrument, said hand support apparatus is engaged to the string musical instrument via manually pulling on either said tie primary or secondary end portions with said means for cinching released and said coil removably engaging a body retention feature with said lanyard engaged to another opposing body retention feature wherein when said tie is manually brought taut wherein then said means for cinching is then engaged to grip said tie to removably secure said hand support apparatus to the musical instrument.

14. A hand support apparatus for a string musical instrument according to claim 13 wherein said lanyard further includes an attached noose that is operational to be engaged to the other opposing body retention feature.

15. A hand support apparatus for a string musical instrument according to claim 14 wherein said noose is removably engaged to said primary end of said tie to said coil being operational to engage said hand support apparatus to the musical instrument when there is no body retention feature disposed on a rear portion of the body of the musical instrument.

16. A hand support apparatus for a string musical instrument according to claim 13 wherein said first and second extension members are constructed of a pliable material.

17. A hand support apparatus for a string musical instrument according to claim 13 wherein said lanyard further includes a friction sleeve that is slidably engaged to said lanyard to further secure said lanyard to the body retention feature.

* * * * *